US005173734A

United States Patent [19]

Shimizu et al.

[11] Patent Number: 5,173,734

[45] Date of Patent: Dec. 22, 1992

[54] IMAGE FORMING APPARATUS USING MEASURED DATA TO ADJUST THE OPERATION LEVEL

[75] Inventors: Tadafumi Shimizu; Masahide Ueda; Shinichiro Tabuchi, all of Toyokawa, Japan

[73] Assignee: Minolta Camera Kabushiki Kaisha, Osaka, Japan

[21] Appl. No.: 669,614

[22] Filed: Mar. 14, 1991

[30] Foreign Application Priority Data

Mar. 19, 1990 [JP] Japan ..... 2-68579

[51] Int. Cl.[5] ..... G03G 15/00

[52] U.S. Cl. ..... 355/208; 355/203; 355/204; 355/219; 355/221; 361/235

[58] Field of Search ..... 355/204, 203, 206, 208, 355/219, 38, 77, 214, 221; 29/233, 130, 132; 361/225, 235

[56] References Cited

U.S. PATENT DOCUMENTS 4,355,885 10/1982 Nagashima ..... 361/235 X
4,564,287 1/1986 Suzuki et al. ..... 355/204 X
4,616,923 10/1986 Reuter ..... 430/35 X
4,647,184 3/1987 Russell et al. ..... 355/219 X
4,736,223 4/1988 Suzuki ..... 355/204 X
4,963,926 10/1990 Ohishi et al. ..... 355/203
5,017,964 5/1991 Sadwick ..... 355/219

FOREIGN PATENT DOCUMENTS 53-136838 11/1978 Japan .
55-17174 2/1980 Japan .
63-106672 5/1988 Japan .
63-296062 12/1988 Japan .

*Primary Examiner*—A. T. Grimley
*Assistant Examiner*—T. A. Dang
*Attorney, Agent, or Firm*—Burns, Doane, Swecker & Mathis

[57] ABSTRACT

An image forming apparatus includes a corona charger, a surface electrometer and a memory provided around a photoreceptor drum. When power supply of the image forming apparatus is turned on, an image adjusting process is carried out. In the image adjusting process, level of charging the corona charger is changed stepwise, the surface potential on the photoreceptor drum at the time is measured by the surface electrometer and the result of measurement is stored in the memory. When image forming process is carried out subsequently, the charge level of the corona charger is set based on the data stored in the memory.

15 Claims, 22 Drawing Sheets

FIG.4

| SET LEVEL (HV LEVEL) | $SW_1$ | $SW_2$ | $SW_3$ | $SW_4$ | $SW_5$ | $SW_6$ | $SW_7$ | $SW_8$ | SURFACE POTENTIAL [V] | REMARKS |
|---|---|---|---|---|---|---|---|---|---|---|
| LEVEL 1 | ON | ON | ON | ON | ON | ON | ON | ON | 590 | LOWER LIMIT |
| LEVEL 2 | ON | ON | ON | ON | ON | ON | ON | — | 605 | |
| LEVEL 3 | ON | ON | ON | ON | ON | ON | — | — | 620 | |
| LEVEL 4 | ON | ON | ON | ON | ON | — | — | — | 635 | |
| LEVEL 5 | ON | ON | ON | ON | — | — | — | — | 650 | STANDARD VALUE |
| LEVEL 6 | ON | ON | ON | — | — | — | — | — | 665 | |
| LEVEL 7 | ON | ON | — | — | — | — | — | — | 680 | |
| LEVEL 8 | ON | — | — | — | — | — | — | — | 695 | |
| LEVEL 9 | — | — | — | — | — | — | — | — | 710 | UPPER LIMIT |

FIG. 7

| SET LEVEL (T/C LEVEL) | NUMBER n OF LEVEL CHANGE TIMES | TONER WEIGHT RATIO T/C [wt%] | OUTPUT VOLTAGE VT [V] OF TONER DENSITY SENSOR 80 | DARK POTENTIAL VO [V] | GRAY POTENTIAL Vi [V] | REMARKS |
|---|---|---|---|---|---|---|
| LEVEL 1 | 0 | 5 | 2.85 | VB + 430 | VB + 130 | STANDARD VALUE |
| LEVEL 2 | 1 | 6 | 2.25 | VB + 410 | VB + 110 | |
| LEVEL 3 | 2 | 7 | 1.60 | VB + 390 | VB + 90 | |
| LEVEL 4 | 3 | 8 | 1.00 | VB + 370 | VB + 70 | UPPER LIMIT |

FIG.10

| SET LEVEL (VB LEVEL) | DESIRED VALUE [V] OF DEVELOPING BIAS VB | REMARKS |
|---|---|---|
| LEVEL 1 | 180 | |
| LEVEL 2 | 190 | |
| LEVEL 3 | 200 | |
| LEVEL 4 | 210 | |
| LEVEL 5 | 220 | STANDARD VALUE |
| LEVEL 6 | 230 | |
| LEVEL 7 | 240 | |
| LEVEL 8 | 250 | |
| LEVEL 9 | 260 | |

FIG.11

| SET LEVEL (EXP LEVEL) | DESIRED VALUE [Lux.sec] OF AMOUNT OF EXPOSURE | REMARKS |
|---|---|---|
| LEVEL 1 | 1.60 | |
| LEVEL 2 | 1.70 | |
| LEVEL 3 | 1.80 | |
| LEVEL 4 | 1.90 | |
| LEVEL 5 | 2.00 | STANDARD VALUE |
| LEVEL 6 | 2.10 | |
| LEVEL 7 | 2.20 | |
| LEVEL 8 | 2.30 | |
| LEVEL 9 | 2.40 | |

7
STATE 56
#561
n = 0 ?
NO
YES
#562
STORE $C_{OK}$
#564
STORE $C_{T/C}$
STATE 57
#571
n = 0 ?
NO
YES
#572
STORE $C_{Vi}$
#573
STORE $C_{Vi}$, $C_{T/C}$
STATE 58
#575
STORE $C_{VR}$
STATE 59
#576
STORE $C_{VO}$
#563
STATE ← 60
RETURN

8
STATE 60
#581
MEASURE TONER IMAGE DENSITY BY PHOTOSENSOR 19
#582
CALCULATE ID FROM VP
#583
FC ← 1
RETURN
STATE 61
#591
STORE $C_{CH}$
#592
FC ← 1
STATE 62
#593
STORE $C_{EXP}$

IMAGE FORMING APPARATUS USING MEASURED DATA TO ADJUST THE OPERATION LEVEL

BACKGROUND OF THE INVENTION

1. Field of the Invention

The present invention relates to an image forming apparatus utilizing electrophotographic process and, more specifically, to an image forming apparatus in which image quality can be adjusted.

2. Description of the Related Art

The electrophotographic process includes a charging process for uniformly charging the surface of a photoreceptor, an exposure process for exposing the surface of the photoreceptor in response to image information for partially removing charges and forming a latent image, a developing process of sticking toner which is contained in a developer to the latent image for forming a toner image, transfer process for transferring the toner image onto a recording paper (hereinafter referred to as "paper"), and a fixing process for fixing the toner image transferred onto the paper, and it is widely used as a method for forming a hard copy image. Image forming apparatuses utilizing the electrophotographic process includes copying machines, facsimiles, and optical printers using a laser or a LED array as a light source.

In such an image forming apparatus, operation levels of various image forming devices (mechanical parts) such as a corona charger, a light source for exposure, a developer are automatically set (hereinafter this setting is referred to as "image adjustment"), so as to provide hard copy images of desired quality. Namely, property values of the electrophotographic process, for example surface potential of the photoreceptor, density of the toner image are susceptible to various environmental influence such as temperature and moisture. The property values are also changed by degradation with time of the respective image forming devices. Therefore, generally, output values of the respective image forming devices are determined at the time of power on, so as to provide the property values corresponding to predetermined appropriate (standard) image quality, in view of the environmental conditions and states of various image forming devices at that time.

A method for forming an image in a conventional image forming apparatus is disclosed in, for example, Japanese Patent Laying-Open No. 55-17174. According to this article, in image adjustment, operation levels of the various image forming devices are changed stepwise. Property values at respective stages are measured, and based on the relation between the operation levels and the property values, an operation level corresponding to a prescribed property value is found by calculation.

Such an image forming apparatus takes shorter time for image adjustment, compared with an image forming apparatus in which image adjustment is done by a so called feed back control in which the operation level is gradually changed to the optimal value while the property values are measured, and therefore image formation becomes possible immediately after the power on.

The above described image adjustment is carried out not only at the time of power on but also at other occasions. For example, setting of the operation levels to provide desired image quality is done when a dark image or a bright image is designated by an operator through a density selecting key, when an image forming mode suitable for a half tone image such as a photograph or suitable for a color image is designated, or some initialization is done after a trouble such as jamming is recovered.

Sometimes, the operation levels are set a plural times in one image adjusting operation. An operation level of one image forming device is temporarily set. Then an operation level of another image forming device is optimized, and the temporarily set operation level of the image device is set again. Namely, generally, setting of the operation levels is carried out a plural times after power on.

However, in a conventional image forming apparatus, measurement of property values is done every time the operation level is set, so that it takes long to set the operation levels at each time.

SUMMARY OF THE INVENTION

Therefore, an object of the present invention is to provide an image of a desired quality in a short period of time in an image forming apparatus.

Another object of the present invention is to reduce time required for setting the operational level at the second and the subsequent times.

A still further object of the present invention is to provide ah image of a desired quality in a short period of time, in a method of forming an image in an image forming apparatus in which image quality is adjusted by adjusting operation levels of image forming devices.

The above described object of the present invention can be attained by an image forming apparatus of the present invention, comprising: a photoreceptor, a charger for charging the photoreceptor, an exposing device for exposing the photoreceptor, a developer for applying toner to the surface of the photoreceptor, a measuring device for measuring surface potential of the photoreceptor, a memory for storing data measured by the measuring device, a first controller controlling the charger, the measuring device and the memory such that operation levels of the charger is changed stepwise at the first setting of the operation level of the charger, surface potential of the photoreceptor at respective operation levels are measured by the measuring device, and the measured data corresponding to the respective operation levels are stored by the memory, and second controller controlling the charger such that at the second and subsequent setting of the operation level of the charger, the operation level of the charger is set based on the measured data read from the memory.

According to the present invention, the operation level of the charger is changed stepwise at the first setting of the operation level, and data of the surface potential at respective operation levels are stored in the memory. In the second and subsequent setting, the operation level of the charger is set based on the stored data. Setting of the operation level to provide desired image quality is done only at the first time. Consequently, desired image quality can be provided in a short period of time in an image forming apparatus.

In accordance with another aspect of the present invention, in an image forming apparatus including an image forming device for forming images on a sheet of recording paper and a measuring device for measuring property values incidental to the image forming process for adjusting image quality by adjusting operation levels of the image forming device, a method of forming images comprises the steps of: changing stepwise the operation level of the image forming device and measuring property values corresponding to the respective operation levels by the measuring device; storing data measured by the measuring device in a memory; setting an operation level of the image forming device based on the measured data; reading the measured data from the memory; and setting the operation level of the image forming device based on the measured data read from the memory.

The operation level of the image forming device is changed stepwise, and property values corresponding to the operation level are stored. Then, the operation level of the image forming device is set based on the stored property values. Property values at each operational level for providing desired image quality are stored in the memory at first, and then the operation level of the image forming device is set based on the stored data. Consequently, a method of forming images capable of providing desired image quality in a short period of time can be provided.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4 shows set levels of the corona charger.

FIG. 7 illustrates relation between set levels of the toner weight ratio, dark potential and gray potential.

FIG. 10 shows set levels of developing bias.

FIG. 11 shows set levels of amount of exposure.

DESCRIPTION OF THE PREFERRED EMBODIMENTS

An embodiment of the present invention will be described with reference to the figures.

Figure 1:
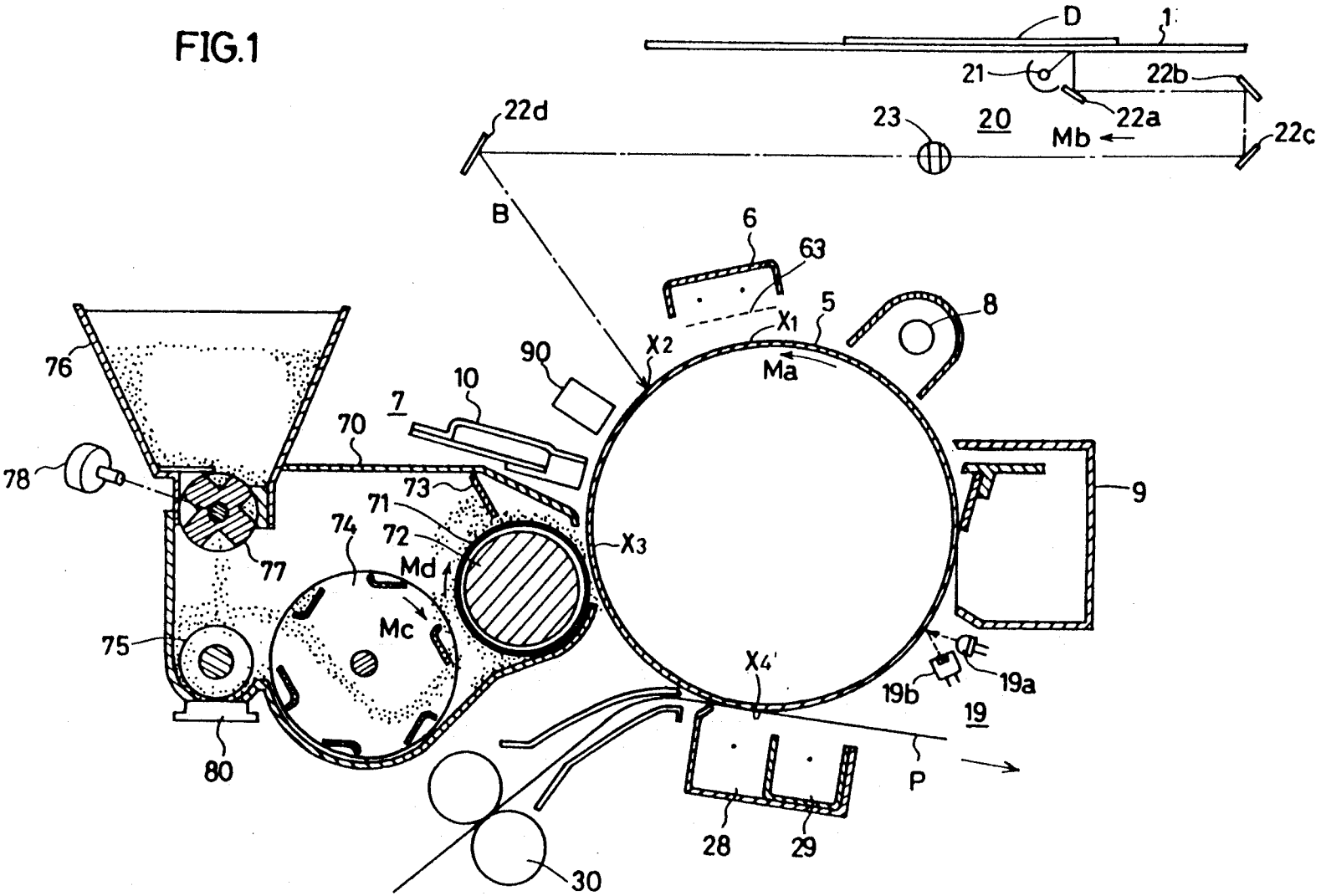
FIG. 1 is a front sectional view showing a principal part of a copying machine in accordance with the present invention.

Referring to FIG. 1, a photoreceptor drum 5 is rotatable along an arrow Ma at a constant peripheral velocity v, while a corona charger 6, an image-to-image eraser 10, a developing unit 7, a transfer charger 28, a copy paper separation charger 29, a cleaning unit 9 and a main eraser 8 for an electrophotographic process are provided around the photoreceptor drum 5. A surface electrometer 90 is provided between an exposure position X2 and image-to-image eraser 10, for measuring the surface potential of the photoreceptor drum 5, while a reflector type photosensor 19 including a light emitting element 19*a* and a light receiving element 19*b* is provided between the copy paper separating charger 29 and cleaning unit 9, for measuring the density of a reference toner image.

The surface of the photoreceptor drum 5 is uniformly charged by passage through the corona charger 6, and exposed at the exposure position X2 by an optical system 20. Surface charges of the photoreceptor drum 5 are partially discharged by such exposure, so that a latent image corresponding to an original D is formed on the surface of the photoreceptor drum 5. Surface charges of portions other than the latent image are erased by the image-to-image eraser 10.

The optical system 20 comprises an exposure lamp 21 for illuminating the original D placed on a platen glass 1, mirrors 22*a* to 22*d* for guiding light B reflected from the original D to the exposure position X2, and a projecting lens 23. The exposure lamp 21 and the mirror 22*a* move along an arrow Mb at a velocity v/m (m: copying magnification) in order to expose/scan the original D, while mirrors 22*b* and 22*c* are movable at a velocity v/2m.

The latent image formed on the surface of the photoreceptor drum 5 is developed by the developing unit 7 into a visible toner image.

The developing unit 7 carries out normal development. In the normal development, a developer which is made of a mixture of a magnetic carrier and insulating toner is used, and toner is applied to the latent image (portion provided with charges, that is, non-exposed portion) passing through a developing position X3 by a well known magnetic brush system. A developing sleeve 71 containing a magnetic roller 72, a brush height regulating plate 73, a bucket roller 74 and a screw roller 75 are provided in the developer tank 70, while a toner density sensor 80 is provided under the screw roller 75.

When the bucket roller 74 is rotated along an arrow Mc, the developer is attracted toward the outer peripheral surface of the developing sleeve 71 by magnetic force of the magnetic roller 72, and carried to the developing position X3 on the basis of rotation of the developing sleeve 71 along an arrow Md. The toner density sensor 80 measures a weight ratio T/C [wt %] of the toner to the entire developer from permeability of the developer.

A toner tank 76 is provided on an upper portion of the developer tank 70, while a toner supply roller 77 is provided on its bottom portion. When the toner supply roller 77 is rotated by the supply motor 78, the toner is supplied from the toner tank 76 to the screw roller 75. The supplied toner is stirred and mixed with the developer already contained in the developer tank 70 by the rotation of the screw roller 75 to be fed to the bucket roller 74. Frictional electrification is caused by the stirring and mixing, so that the magnetic carrier and the toner are charged with charges of opposite polarity. Negative toner is sticked to the surface of the photoreceptor drum 5 at the developing position X3 due to electrostatic attraction to the charges on the surface of the photoreceptor drum 5. At this time, a prescribed developing bias voltage VB is applied to the developing sleeve 71 in order to prevent adhesion of toner by remanent charge (charges remaining on the exposed portion) on the surface of the photoreceptor drum 5.

A sheet of paper P is fed by timing rollers 30 in timing with rotation of the photoreceptor drum 5, and the transfer charger 28 transfers the toner image onto the paper P at a transfer position X4. The sheet of paper P on which the toner image is transferred is separated from the photoreceptor drum 5 by the copy paper separation charger 29 to be fed to a fixing unit, not shown.

Thereafter, the cleaning unit 9 removes residual toner from the surface of the photoreceptor drum 5, and the main eraser 8 removes the remanent charges for preparation for next exposure.

Figure 2:
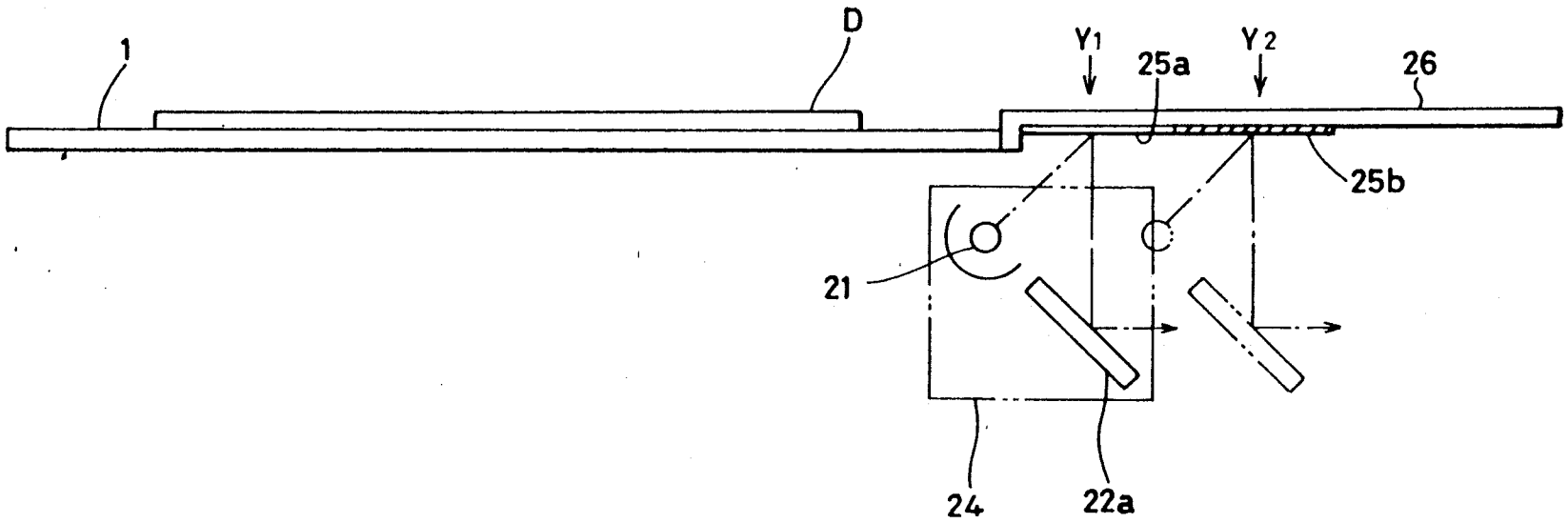
FIG. 2 shows, in enlargement, a portion of an optical system.

Referring to FIG. 2, a slider unit 24 supporting the exposure lamp 21 and the mirror 22*a* is provided reciprocable under the platen glass 1 in order to expose/scan the original D in copying operation as described above, and the slider unit 24 is located at an adjustment position Y1 or Y2 in an image adjustment, which will be described later.

Adjusting seals 25*a* and 25*b* are put on the lower surface of a body cover 26 for the copying machine A, corresponding to the adjusting portions Y1 and Y2. The adjusting seal 25*a* has reflectance which corresponds to the background (white background) of an ordinary original paper, while the adjusting seal 25*b* has reflectance which corresponds to a gray background (halftone image).

Figure 3:
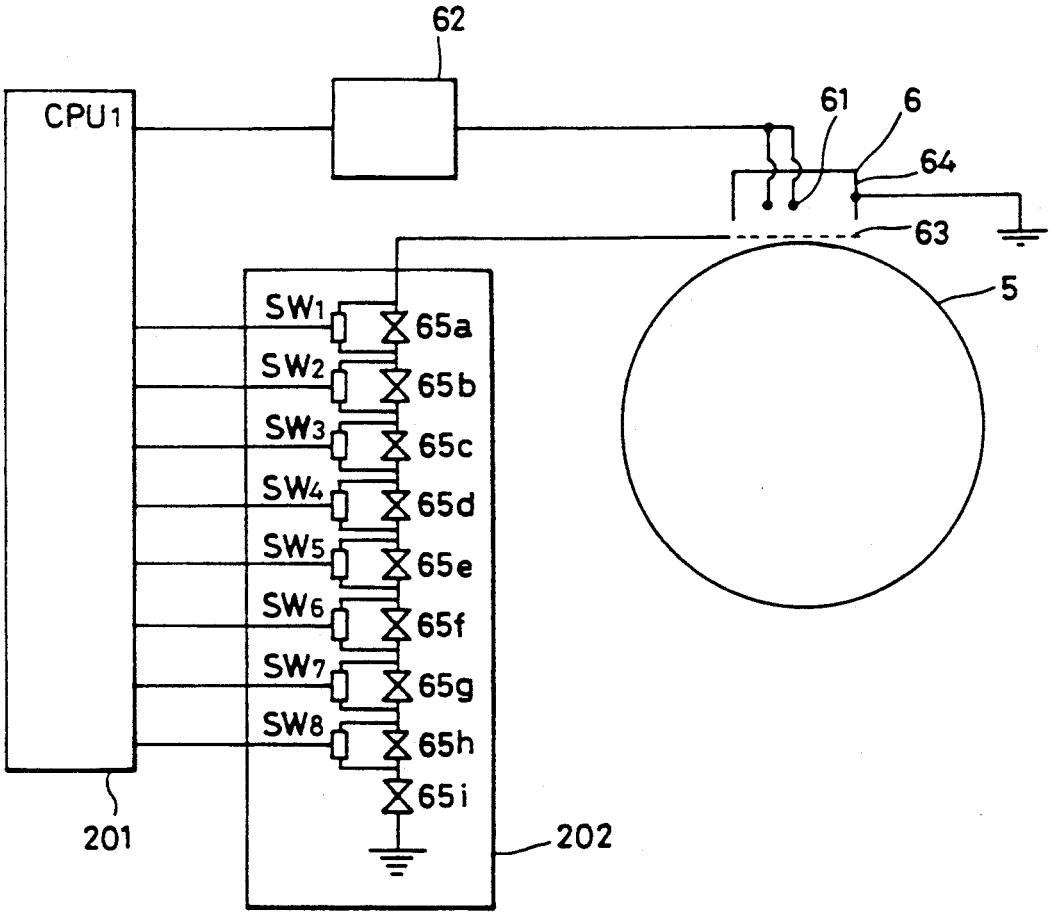
FIG. 3 shows a structure of an output circuit and a corona charger.

Referring to FIG. 3, the corona charger 6 is a scorotron type charger including a charge wire 61, a stabilizer 64 and a mesh-type grid 63.

The charge wire 61 is supplied with a constant high voltage by a high voltage transformer 62, which is on/-off controlled by a first CPU 201 as described later. The grid 63 is grounded through series-connected varisters 65*a* to 65*i* in an output circuit 202. Respective terminals of the varisters 65*a* to 65*h* can be short-circuited by short circuiting switches SW1 to SW8. The short circuiting switches SW1 to SW8 are turned on/off by control signals from the first CPU 201, whereby the potential of the grid 63 is controlled. Thus, the amount of charges delivered from the charge wire 61 to the surface of the photoreceptor drum 5 is controlled to set the surface potential of the photoreceptor drum 5.

Referring to FIG. 4, rated voltages of the varisters 65*a* to 65*h* are set at 15 V, and the rated voltage of the varister 65*i* is set at 790 V. The surface potential of the photoreceptor drum 5 can be set in nine stages of levels 1 to 9 around a standard level 5 at the pitch of 15 V. At the level 5, for example, the short circuiting switches SW1 to SW4 are turned on so that the surface potential of the photoreceptor drum 5 is 650 V. Alternatively, the rated voltages of the varisters 65*a* to 65*h* can differ from each other so as to increase the number of levels.

In the following description, the set levels of the corona charger 6 are referred to as "HV levels".

Figure 5:
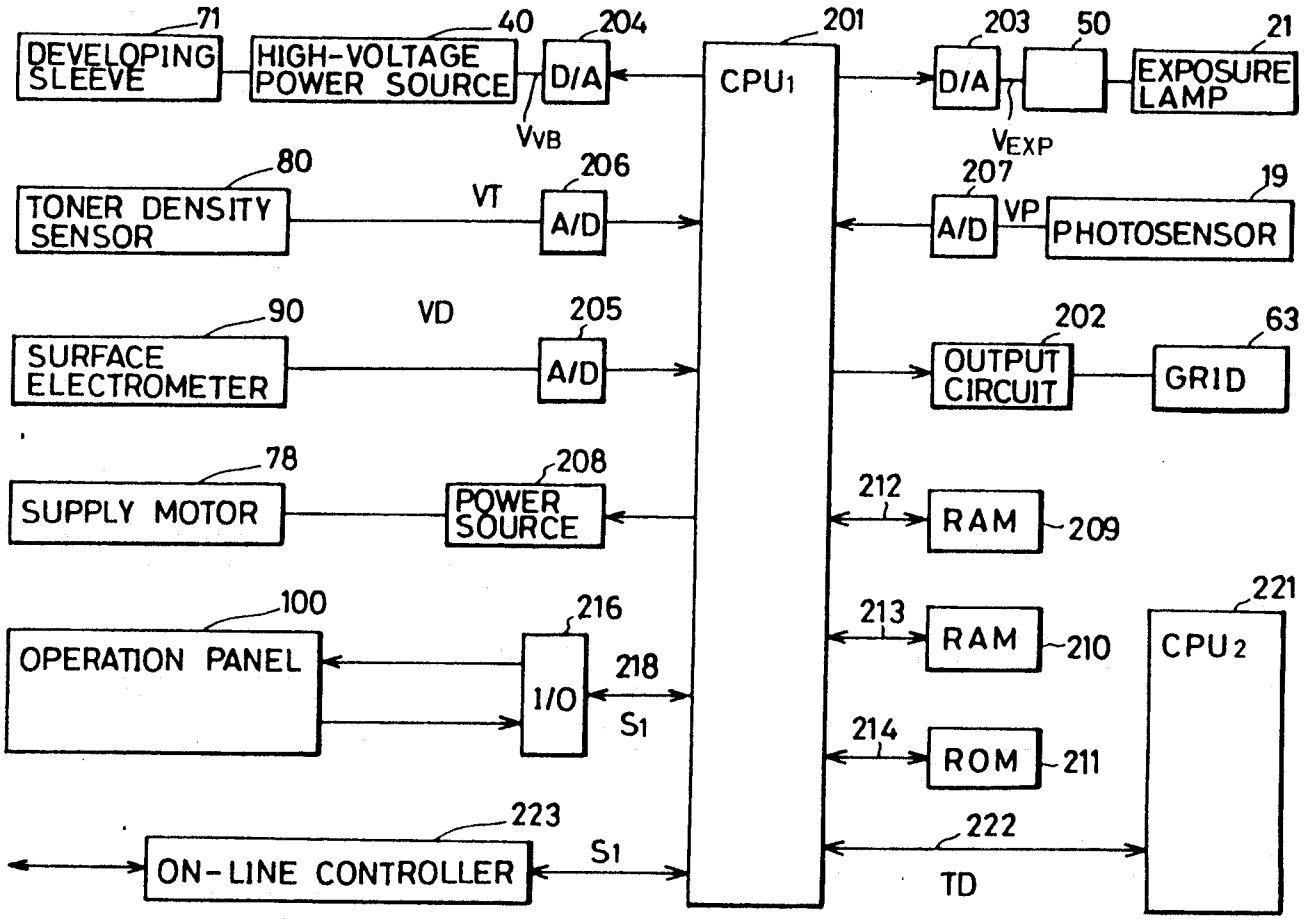
FIG. 5 is a block diagram showing a control circuit for the copying machine.

Referring to FIG. 5, the control circuit 200 of the copying machine A includes a first CPU 201 which controls the overall copying apparatus A, a second CPU 221 having a clock function, RAMs 209 and 210 and a ROM 211. The RAM 209 is backed up by a main power supply, not shown, and is initialized when the main power supply is turned off. The RAM 210 is backed up by a battery, and the data written in the RAM 210 is maintained regardless of the on/off of the main power supply. The RAMs 209 and 210 and the ROM 211 are connected to the first CPU 201 through data buses 212 to 214, respectively.

An output voltage VD of the surface electrometer 90, an output voltage VD of the toner density sensor 80 and an output voltage VP of the photosensor 19 are converted to digital signals by A/D converters 205 to 207 respectively to be input to the first CPU 201. The first CPU 201 applies control signals to an exposure lamp source 50 for lighting the exposure lamp 21 and a high voltage source 40 for applying the developing bias VB, by converting the control signals to control voltages $V_{EXP}$ and $V_{VB}$ by D/A converters 203, 204, respectively. A power supply 208 for driving a supply motor 78, an interface 216 for exchanging data between an operation panel 100 and first CPU 201, an on-line controller 223 for communication with external devices such as a host computer are further provided.

Figure 9:
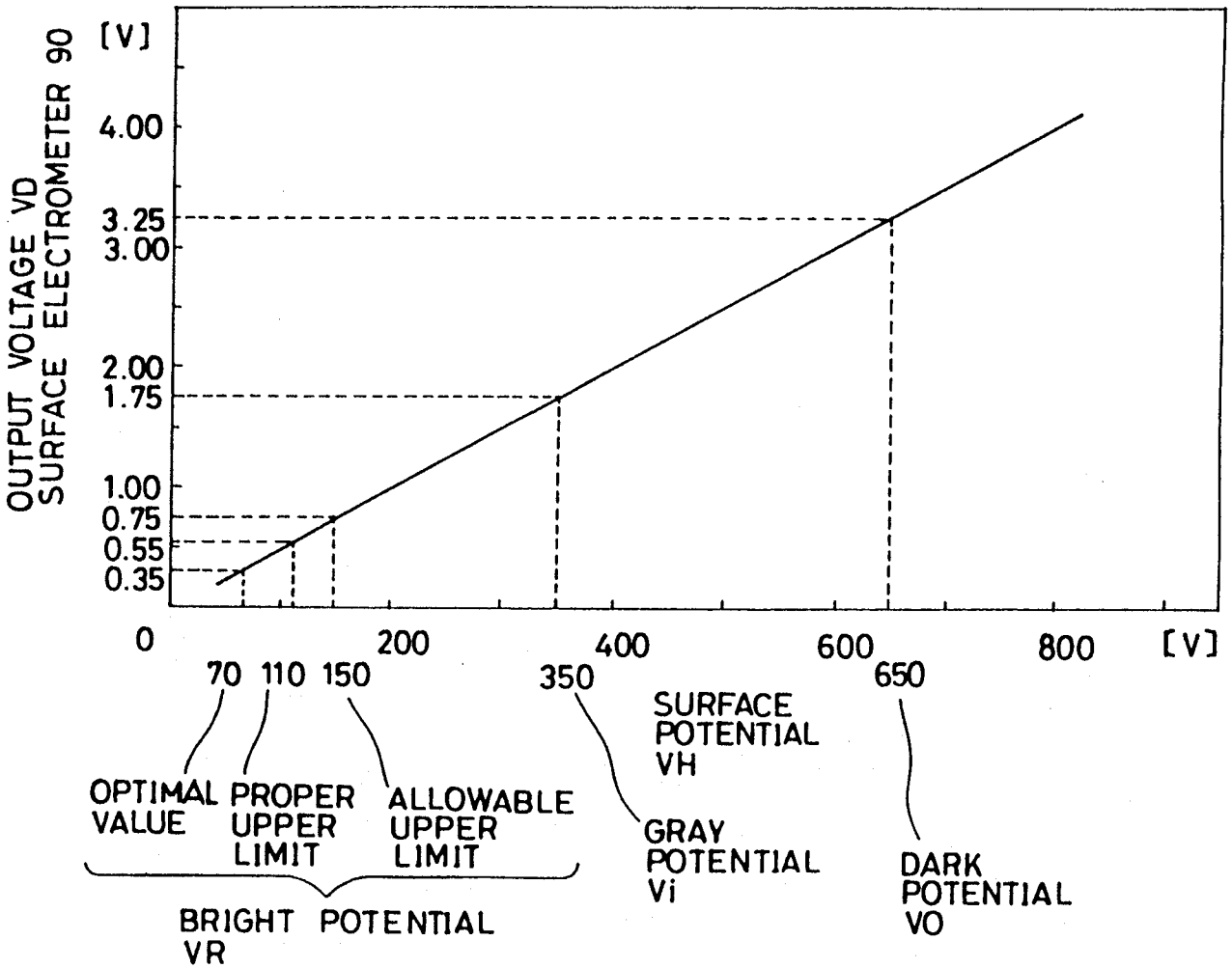
FIG. 9 is a graph showing relation between surface potential of a photoreceptor drum and output voltage of a surface electrometer.

FIG. 9 is a graph showing relation between the surface potential VH of the photoreceptor drum 5 and the output voltage VD of the surface electrometer 90.

As shown in the figure, when the surface potential VH is 70 V, the output voltage VD of the surface electrometer 90 is 0.35 V, when VH is 350 V, the output voltage VD is 1.75 V, and when the surface potential VH is 650 V, the output voltage VD is 3.25 V. The values 70 V, 350 V and 650 V of the surface potential VH are regarded as standard values for bright potential VR, gray potential Vi and dark potential VO of the copying machine A, respectively.

The bright potential VR corresponds to a portion discharged by exposure (corresponding to the white background portion of the original D) and it is not reduced to 0 V even in the best state, due to the remanent charge. The bright potential VR is proper if the same is not more than 110 V, improper but not abnormal in excess of 110 up to 150 V, and abnormal in excess of 150 V. In this embodiment, the potential of an exposure potion corresponding to the adjusting seal 25*a* is regarded as the bright potential VR.

The gray potential Vi is the potential of an exposed portion corresponding to the adjusting seal 25*b* shown in FIG. 2, and the dark potential VO is the potential of an unexposed portion (black portion) on the surface of the photoreceptor drum 5. The gray potential Vi, the dark potential VO and the developing bias VB are determined on the basis of the bright potential VR. The following equations (1) to (3) show optimum values corresponding to standard electrophotographic process conditions, which are defined in view of configurations, materials and the like of the aforementioned photoreceptor drum 5, the developing unit 7 and the like:

$$VB = VR + 150 \quad (1)$$

$$Vi = VB + 130 \quad (2)$$

$$VO = VB + 430 \quad (3)$$

FIG. 10 shows set levels of the developing bias VB.

As understood from the equation (1), the optimum difference between the developing bias voltage VB and the bright potential VR is 150 V. If the difference is smaller than 150 V, the toner adheres to the exposed portion (provided with remanent charges), and if it exceeds 150 V, it leads to adhesion of the magnetic carriers.

In this embodiment, the developing bias VB can be set in nine stages at the pitch of 10 V around a level 5 the desired value of which is a standard developing bias VB (220=70+150 V), in order to provide proper developing bias voltage VB corresponding to variations of the bright potential VR. In the following description, the set levels of the developing bias voltage VB will be referred to as "VB levels".

Figure 6:
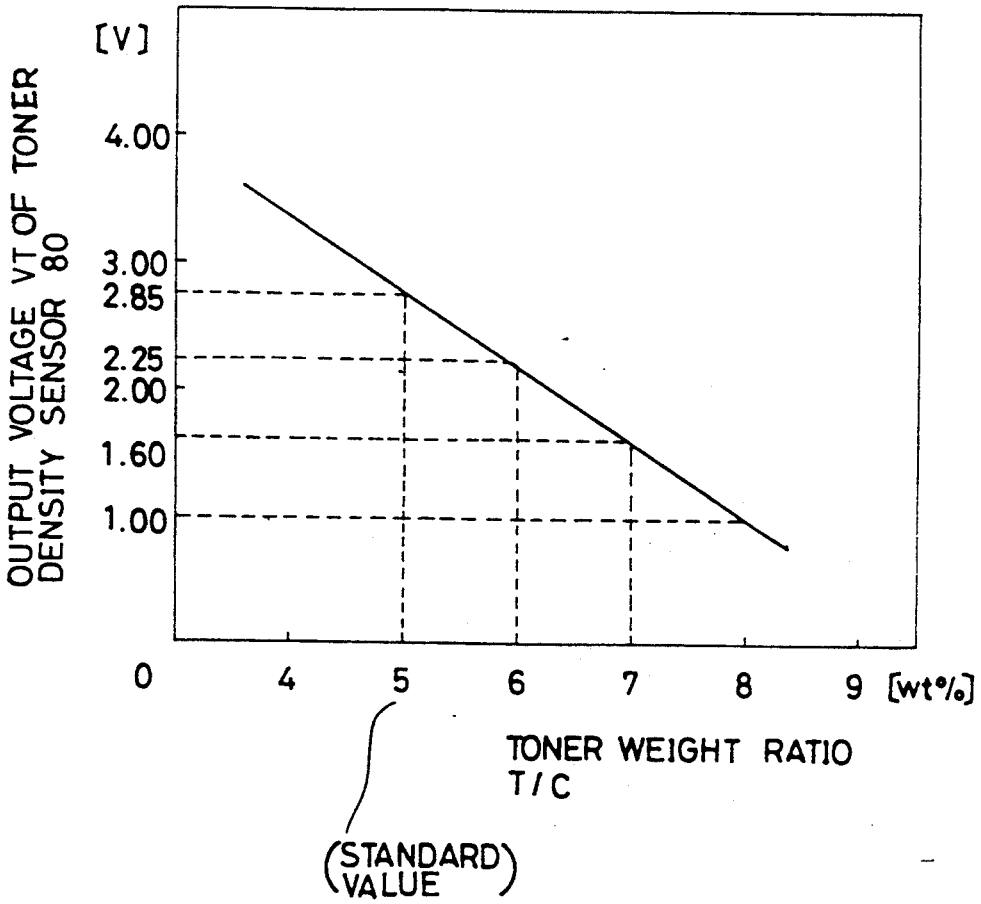
FIG. 6 is a graph showing relation between toner weight ratio and output voltage of a toner density sensor.

FIG. 6 is a graph showing relation between the toner weight ratio T/C and the output voltage VT of the toner density sensor 80.

The value of the toner weight T/C defined as a standard electrophotographic process condition (standard value) is 5 [wt %], and the output voltage VT of the toner density sensor 80 is 2.85 V. When copying operation is made with the toner weight ratio T/C set at the standard value, the first CPU 201 compares the reference potential 2.85 V with the output voltage VT. When the output voltage VT is higher than 2.85, that is, when the toner weight ratio T/C is lower than the standard value, the first CPU 201 turns on the power supply 208 of the supply motor 78 to supply toner, approaching the toner weight ratio T/C to the standard value.

Such control for maintaining the toner weight ratio T/C at the set value is performed at anytime during copying operation, while the set value of the toner weight ratio T/C is changed on the basis of self-diagnosis in image adjustment, which will be described later.

FIG. 7 shows relation between set values of the toner weight ratio T/C, the dark potential VO and the gray potential Vi. In this embodiment, the toner weight ratio T/C can be set in four stages of levels 1 to 4. In the following description, the set levels of the toner weight ratio T/C will be referred to as "T/C levels".

Generally, efficiency in development is improved as the value of the toner weight ratio T/C becomes larger. Therefore, it is possible to provide a hard copy image of an appropriate density by increasing the toner weight ratio T/C, even if the potential difference between the photoreceptor drum 5 and the developing sleeve 71 is made small. Therefore, in the image adjusting process as described later, if output adjustment of the corona charger 6 reaches a limit when the toner weight ratio T/C is at a standard level, that is, T/C level "1", the T/C level is changed. However, if the toner weight ratio T/C exceeds 8 [wt %], excessive driving torque is applied to the bucket roller 74 and the like, and toner overflows from the developing tank 70, so that the upper limit of the toner weight ratio T/C is set at 8 [wt %].

FIG. 11 shows set levels of the amount of exposure. The amount of exposure is set by controlling lighting power which is supplied from the exposure lamp source 50 to the exposure lamp 21. In the copying machine A, the amount of exposure can be set in nine stages within a range of 1.6 to 2.4 [Lux·sec] around a level 5, the desired value of which is 2.00 [Lux·sec]. In the following description, the set levels of the exposure amount will be referred to as "EXP levels".

Figure 8:
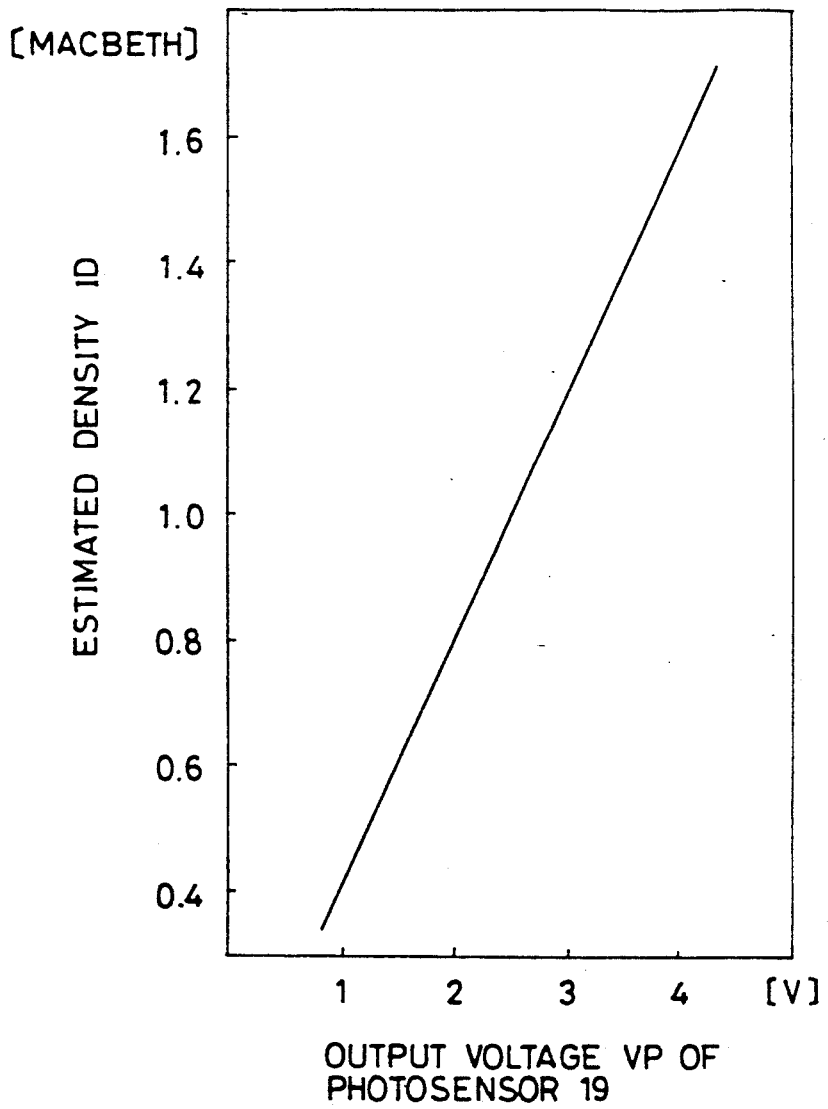
FIG. 8 is a graph showing relation between output voltage of a photosensor and estimated density.

FIG. 8 is a graph showing relation between the output voltage VT of the photosensor 19 and the estimated density ID.

This graph corresponds to the relation between the density of a toner image formed on the photoreceptor drum 5 and the density actually measured as to a hard copy image obtained by transferring and fixing the toner image on the sheet of paper P. For example, when the value of the output voltage VP is "2.5", the density of the formed hard copy image can be estimated to 1.0 [Macbeth]. Graph data GD are previously stored in the ROM 211.

The first CPU 201 refers to the data of the ROM 211, and calculates the estimated density ID of the hard copy image formed in the copying operation, based on the output voltage VP of the photosensor 19. More specifically, the density of the hard copy image visually observed by an operator is estimated on the toner image density (reflectance of the toner image), which is one of the property values incidental to the electrophotographic process.

The operation of the copying machine A will be described with reference to flow charts of FIGS. 12 to 14.

Figure 12:
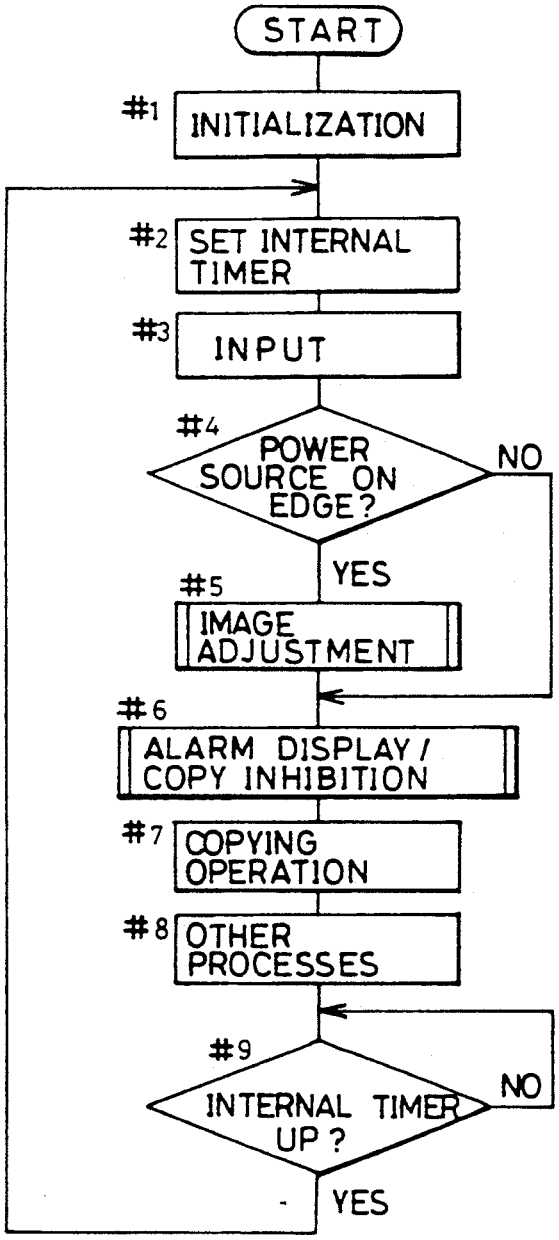
FIGS. 12 to 14 are flow charts showing operation of the copying machine.
Figure 13A:
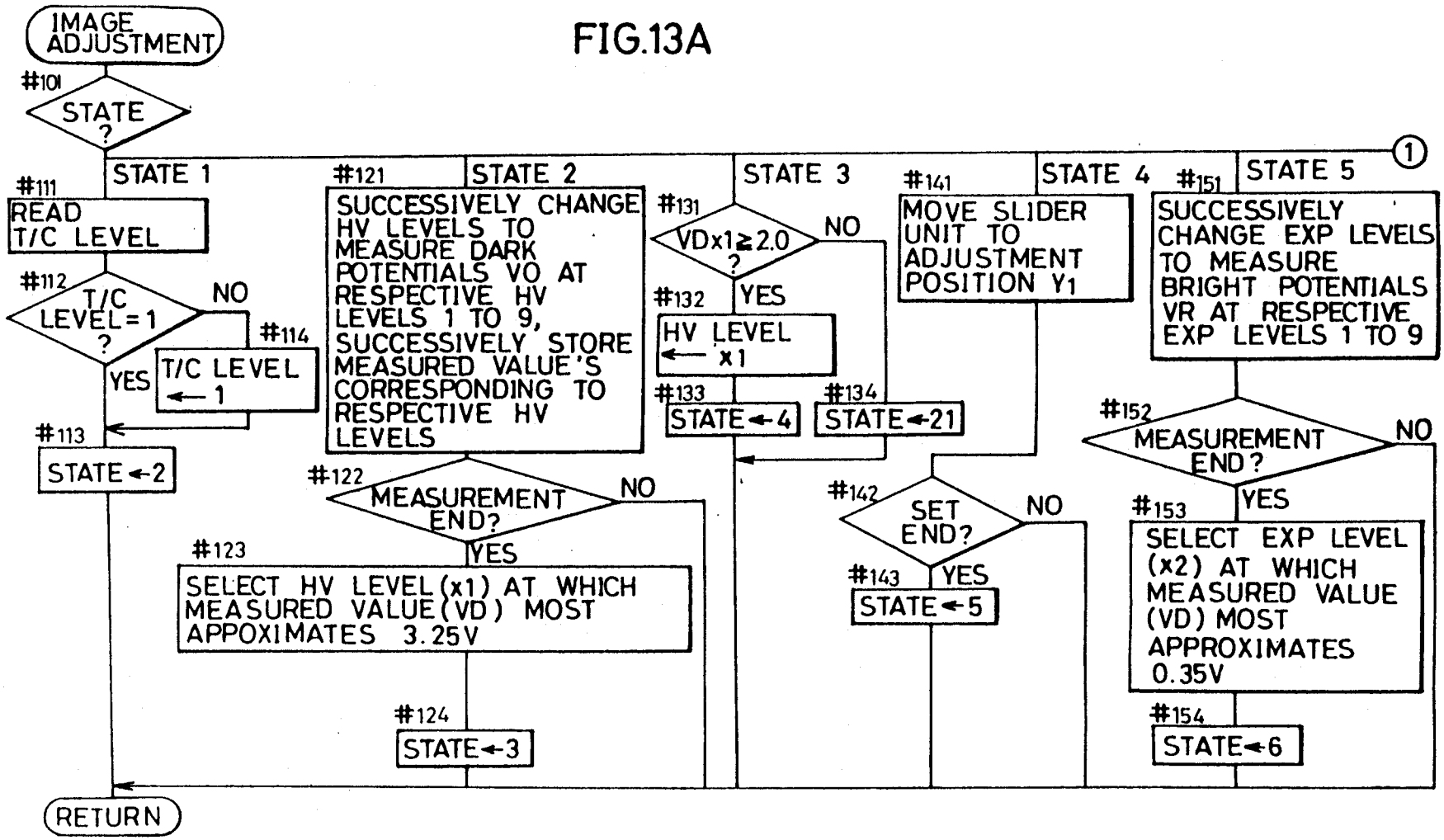
Figure 13B:
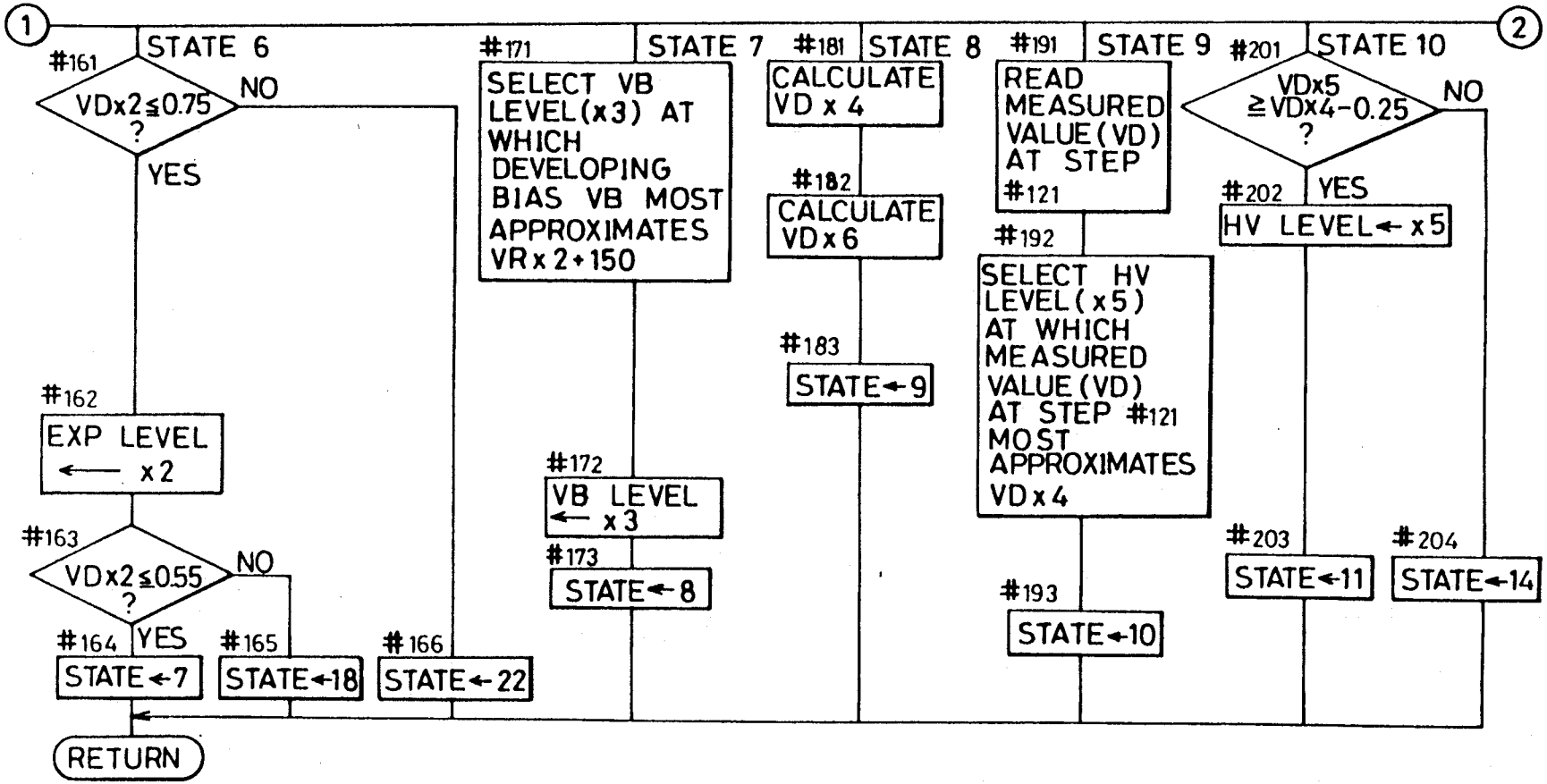
Figure 13C:
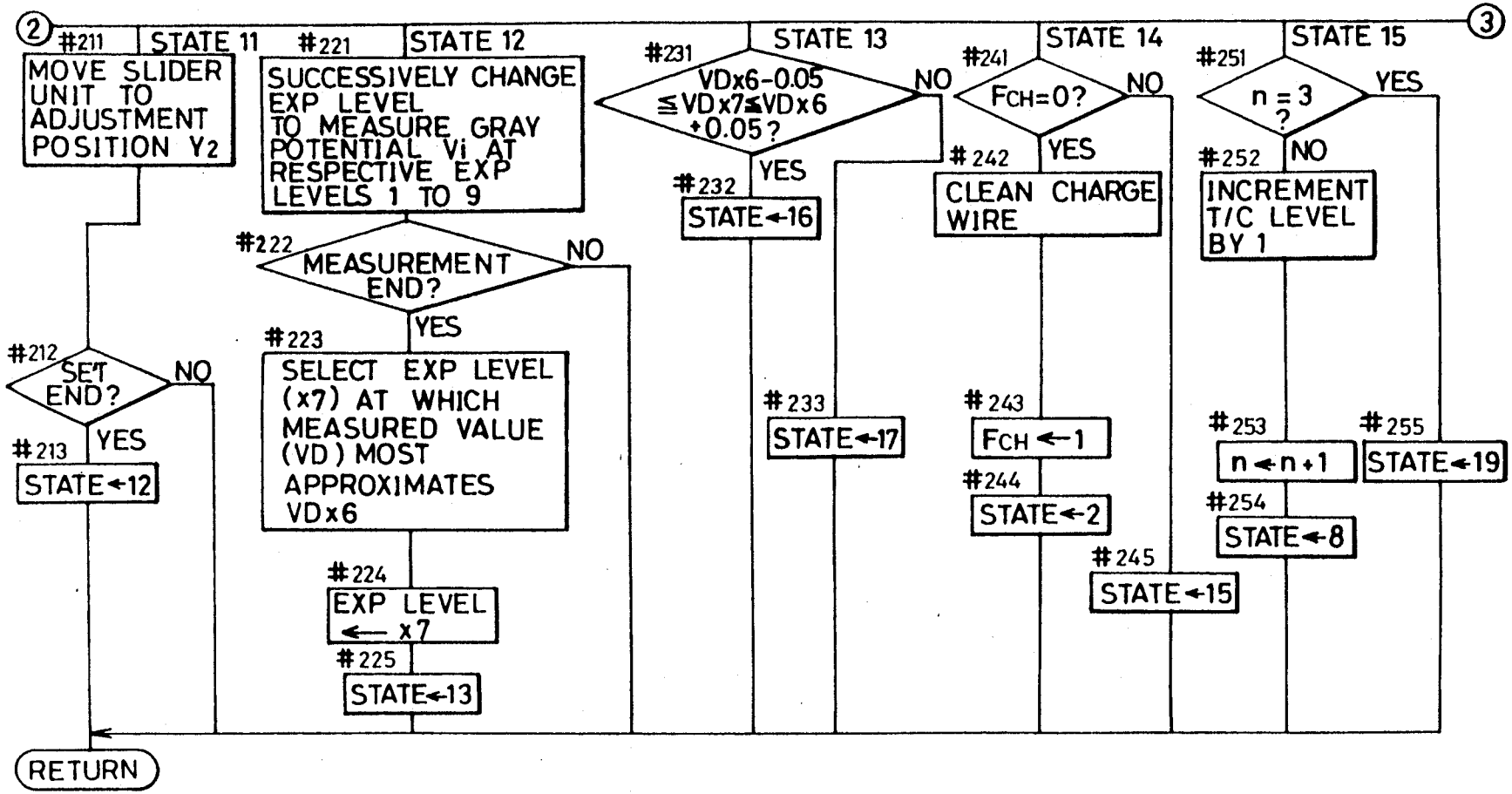
Figures 13D, 13E:
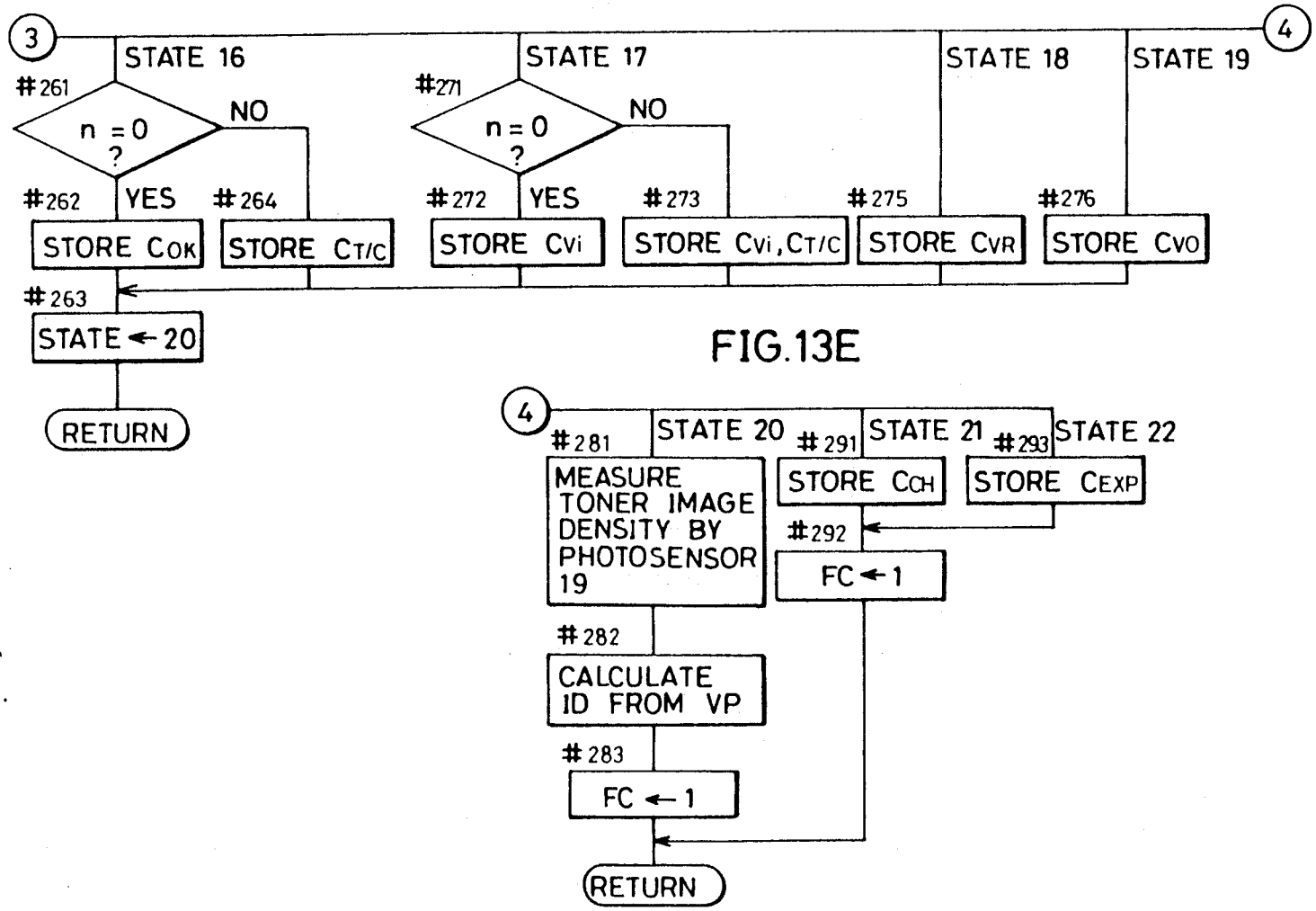

FIG. 12 is a main flow chart schematically showing the operation of the first CPU 201.

When the program starts at power on, initialization of various portions is done in step #1, and an internal timer defining length of 1 routine of the first CPU 201 is set in step #2. Input process for receiving signals from operation keys on an operation panel 100 and from switches and sensors at various portions is done in step #3.

In step #4, whether or not it is immediately after the power on of the power supply, that is, whether or not it is an on edge where the power supply is changed from off to on is determined. If it is (YES), the program proceeds to step #5 (image adjusting process) Otherwise (NO in step #4), the program jumps the step #5 and executes step #6 (alarm display, inhibition of copying operation). Namely, the image adjusting process is carried out only when the power is turned on.

Then other processes including copying operation (step #7) and communication with the second CPU 221 (step #8) are carried out.

After these processes are executed, the program waits for the internal timer in step #9 and returns to the step #2. By this operation, the length of 1 routine is maintained constant, and processes from step #2 to step #9 are repeated while the power is on.

FIGS. 13A to 13E are flow charts of the image adjusting process of the step #4 mentioned above.

In this routine, different processes are carried out based on self-diagnosis determining whether the operation state of the copying machine A is in the proper state, improper state in which image formation is possible but set values at respective portions are not the standard values, or an abnormal state in which image formation is impossible. More specifically, in this routine, setting processes for image adjustment (states "1" to "15") for setting various devices around the photoreceptor drum 5 and state storing processes (states "16" to "22") for storing states data indicative of the states of respective portions provided by self-diagnosis are carried out.

In this routine, state check is done in step #101 at first, and the following processes are executed corresponding to the state.

In state "1", the T/C level at present is read from the RAM 209 in step #111. Whether or not the T/C level is "1", that is, whether it is set at the standard T/C level is determined (step #112), and if it is YES, the state is set to "2" in step #113. If it is NO in step #112, the T/C level is set to "1" in step #114.

In state "2", the corona charger 6 is turned on with the exposure lamp 21 being off in step #121, the photoreceptor drum 5 is rotated while the HV levels changed successively, and the dark potential VO at respective HV levels "1" to "9" is measured. The measured values VD at the respective HV levels are successively stored in the RAM 209.

In step #122, whether or not the measurement for all HL levels "1" to "9" is completed is determined.

If it is YES in step #122, the HV level "x1" (one of the HV levels "1" to "9") at which the measured value provided in the step #121, that is, the output voltage VD from the surface electrometer 90 is nearest to 3.25 V corresponding to the standard value (650 V) of the dark potential VO is selected in step #123. Then the state is set to "3" (step #124).

In the state "3", whether or not the value of the output voltage VD "VDx1" at the HV level "x1" selected in the proceeding state "2"≧2.0 V is determined. In other words, whether or not the dark potential VO≧ the lower limit (400 V) enabling the copying operation is checked. If it is YES in step #131, the HV level "x1" is set as the temporary HV level in step #132.

If it is NO in step #131, it means that a serious trouble such as disconnection of the charge wire 61 of the corona charger 6 is taking place, and therefore copying operation is impossible. Namely, the copying machine A is in an abnormal state. In such a case, the state is set to "21" (step #134).

In state "4", the slider unit 24 of the optical system 20 is moved to the adjustment position Y1 (step #141), completion of setting of the slider unit 24 is confirmed (step #142), and state is set to "5" (step #142).

In state "5", the EXP level is changed successively to irradiate the adjustment seal 25*a* with the exposure lamp 21 lighted in step #151, to measure the bright potential VR at respective EXP levels "1" to "9".

In step #152, completion of measurement at respective EXP levels is confirmed, and in step #153, an EXP level "x2" at which the value of the output voltage VD from the surface electrometer 90, that is, the measured value provided in the step #151 is nearest to 0.35 V corresponding to the standard value (70 V) of the bright potential VR is selected. Then the state is set to "6" (step #154).

In state "6", whether or not the value of the output voltage VD "VDx2" at the EXP level "x2"≦0.75 V is determined in step #161. Namely, whether or not the bright potential VO≦ the upper limit (150 V) enabling the copying operation is determined.

If it is NO in step #161, it means that a trouble such as malfunction of the exposure lamp 21 is taking place, and therefore copying operation is impossible. Namely, the copying machine A is in an abnormal state. In such a case, the program proceeds to step #166 in which the state is set to "22".

If it is YES in step #161, the EXP level "x2" is set as the temporary EXP level in step #162.

In the succeeding step #163, whether or not the actually measured value "VDx2"≦0.55 V is determined.

If it is YES in step #163, setting of the developing bias voltage VB satisfying the above equation (1) is possible, and thus copied image of proper quality can be formed. The state of the copying machine A is proper. In this case, the state is set to "7" in step #164.

If it is NO in step #163, it means that although execution of the copying operation is possible, the developing bias voltage VB satisfying the equation (1) can not be set even if the VB level "9" which is the limit in adjustment is selected. Namely, the image quality of the copied image may be unsatisfactory. Therefore, the operation state of the copying machine A is improper. In this case the state is set to "18" (step #165).

In state "7", the developing bias voltage VB which is one of the conditions for electrophotographic process is determined.

More specifically, the value of the bright potential VR "VRx2" corresponding to the above mentioned actually measured value "VDx2" is calculated, the VB level "x3" at which the target value of the developing bias VB becomes nearest to "VRx2+150" is selected (step #171), and the VD level "x3" is set as the VB level (step #172). If the actually measured value "VDx2" is 0.35 V, for example, the value of the bright potential VR "VRx2" corresponding thereto is the optimal value, that is, 70 V (see FIG. 9), and setting of the VB level "5" is done, with the desired value being 220 (70+150)V (see FIG. 10). In step #173, the state is set to "8".

In state "8", the value of the developing bias VB "VBx3" at the VB level "x3" is substituted for the equation shown in FIG. 7 to calculate the desired value "VOx4" of the dark potential VO in step #181, and a value "VDx4" of the output voltage VD corresponding to the target value "VOx4" is calculated.

Then, in step #182, the value "VBx3" is substituted for the equation of the gray potential Vi shown in FIG. 7 to calculate the desired value "Vix6" of the gray potential Vi, and the value "VDx6" of the output voltage VD corresponding to the desired value "Vix6" of the gray potential is calculated. Then the state is set to "9" in step #183.

In state "9", measurement of the surface potential VH corresponding to the respective HV levels is not carried out but the measured values VD stored in the step #121 of the aforementioned state "2" are read (step #191), and the HV level "x5" at which the measured value VD is nearest to the calculated value "VDx4" is selected (step #192).

Then the state is set to "10" (step #193).

In state "10", whether or not the actual dark potential VO is in the proper range defined corresponding to the calculated desired value is determined in step #201. In other words, whether or not the relation between the calculated value "VDx4" and the actually measured value "VDx5" of the output voltage VD corresponding to the HV level "x5" satisfies the next equation (4) is determined.

$$VDx5 \geqq VDx4 - 0.25[V] \quad (4)$$

The difference of 0.25 V in the output voltage VD is equivalent to 50 V of the surface potential VH.

If it is YES in step #201, it means that the dark potential VO is proper, so that the HV level "x5" is set as the HV level (#202), and the state is set to "11" (step #203).

Namely, in setting the HV level at this time, the measured value VD measured in advance is utilized.

If it is NO in step #201, the state is set to "14" in step #204. In this case, the dark potential VO is lower than the proper value and therefore the operation state is in improper. If the copying operation is done in the improper state, the amount of toner applied is small, so that the image becomes light.

In state "11", the slider unit 24 is moved to the adjustment position Y2 (#211), completion of setting of the slider unit 24 is confirmed (step #212), and the state is set to "12" (step #213).

In state "12", the EXP level is changed successively with the exposure lamp 21 being on to irradiate the adjustment seal 25*b* in step #211 to measure the gray potentials Vi at the respective EXP levels "1" to "9", and whether or not the measurement for all the EXP levels is completed is confirmed in step #222.

Then the EXP level "x7" at which the value of the output voltage VD which is the value measured in the step #221 is the nearest to the calculated value "VDx6" is selected (step #223), and the EXP level "x7" is set as the EXP level (step #224). The state is set to "13" in step #225.

In state "13", whether or not the actual gray potential Vi is in a proper range such as (Vix6±10 V) determined based on the calculated target value "Vix6" is determined. In other words, whether or not the relation between the calculated value "VDx6" and the actually measured value "VDx7" of the output voltage VD corresponding to the EXP level "x7" satisfies the following equation (5) is checked.

$$VDx6-0.05 \leqq VDx7 \leqq VDx6+0.05\ [V] \quad (5)$$

If it is YES in step #231, the gray potential VO is proper, and the program proceeds to step #232 in which the state is set to "16".

If it is NO in step #231, it means that the gray potential VO is improper, and the state is set to "17" in step #233.

The program defined in the state "14" is executed when the dark potential VO is determined to be improper in the above mentioned state "10". In step #241, whether or not a charger flag $F_{CH}$ indicating the state of cleaning of the charge wire 61 is "0" is determined.

If it is YES in step #241, it means that the charge wire 61 has not been cleaned, and therefore it is assumed that the improper dark potential VO is caused by the dirt on the charge wire 61. Accordingly, the charge wire 61 is cleaned in step #242. Then, in step #243, the charger flag $F_{CH}$ is set to "1" and the state is set to "2" in step #244. Therefore, if it is YES in step #241, processes following the state "2" is executed again with the charge wire 61 cleaned.

If it is NO in step #241, it means that proper dark potential VO cannot be provided, although the charge wire 61 has been cleaned. In this case, the state is set to "15" in step #245.

In state "15", whether or not the number n of changing the T/C level is "3" is checked in step #251.

If it is NO in step #251, the flow proceeds to step #252, in which the T/C level is incremented by 1 level. Namely, the T/C level is changed so as to increase the toner weight ratio T/C. For example, if the currently set T/C level is "1", it is changed to T/C level "2". Then the number n of change is incremented by 1 in step #253, and the state is set to "8" in step #254.

Therefore, if it is NO in step #251, respective target values of the dark potential VO and the gray potential Vi corresponding to the new T/C level are calculated as shown in FIG. 7, and the HV level and the EXP level are set so as to provide proper image based on the target values.

If is YES in step #251, it means that the T/C level "4" has been set as the T/C level, and the T/C level has already reached the limit in adjustment. Therefore, the T/C level is not changed, and the state is changed to "19" in step #255.

In state "16", whether or not the number n of change is "0" is determined in step #261. If it is YES in step #261, it means that the standard T/C level "1" has been set as the T/C level, so that state data $C_{OK}$ indicating that the T/C level is proper is stored in step #262. The storage in this routine is realized by storing data in the RAM 209.

If it is NO in step #261, state data $C_{T/C}$ indicating that the T/C level is improper is stored in step #264. After the execution of the step #262 or step #264, the state is set to "20" in step #263.

In state "17", whether or not the number n of change is "0" is checked in step #271. If it is YES, state data $C_{Vi}$ indicating that the gray potential Vi is improper is stored (step #272), and if it is NO, the state data $C_{Vi}$ and the state data $C_{T/C}$ are stored (step #273). After the execution of the step #272 or step #273, the program proceeds to the above mentioned step #263.

In state "18", state data $C_{VR}$ indicating that the bright potential VR is improper is stored (step #275).

In state "19", state data $C_{VO}$ indicating that the dark potential VO is improper is stored (step #276).

In state "20", a process for estimating density of the hard copy image provided under the electrophotographic process conditions set as described above is executed.

Namely, in step #281, density of three different toner images, that is, toner image formed with the exposure lamp 21 being off (toner image corresponding to black), toner image formed with the exposure lamp 21 being on at the adjustment position Y1 (toner image corresponding to white), and a toner image formed with the exposure lamp 21 being on at the adjustment position Y2 (toner image corresponding to gray) is measured by using the photosensor 19.

Then, in step #282, the estimated density ID of the hard copy image is calculated based on the output voltage VP from the photosensor 19 and the graph data GD1 stored in the ROM 211, so as to provide estimated density data $ID_0$, $ID_R$ and $ID_i$ corresponding to the three different hard copy images, black, white and gray.

Then in step #283, image adjustment completion flag FC indicating that setting of various devices around the photoreceptor drum 5 is completed, is set to "1".

In state "21", state data $C_{CH}$ indicating that the corona charger 6 is in an abnormal state is stored, based on self-diagnosis in the above described state "3", in step #291. In step #292, the image adjustment completion flag FC is set to "1".

In state "22", state data $C_{EXP}$ indicating that the exposure lamp 21 is in an abnormal state is stored based on the self-diagnosis in the state "6" (step #293), and the flow proceeds to step #292.

Figure 14:
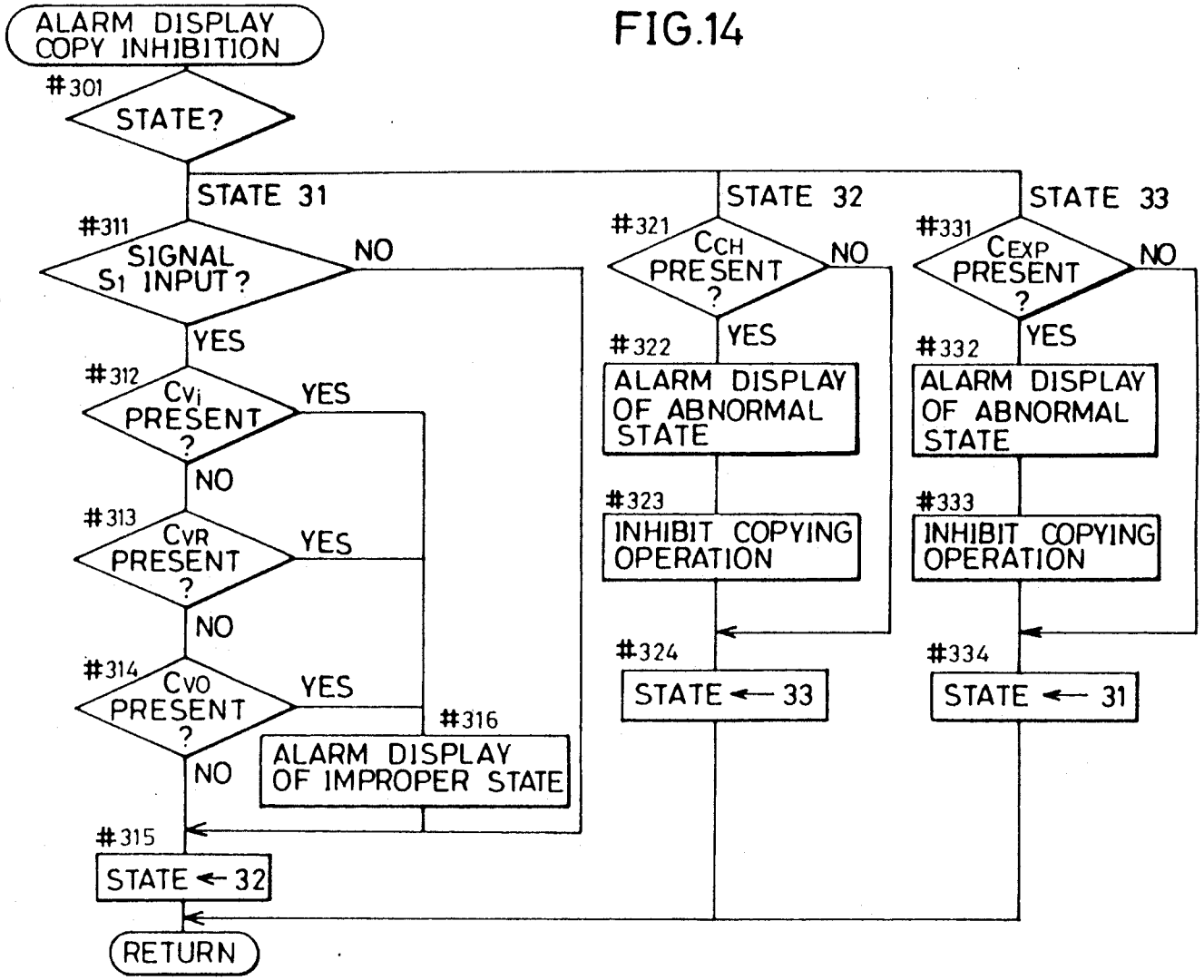
Figure 15A:
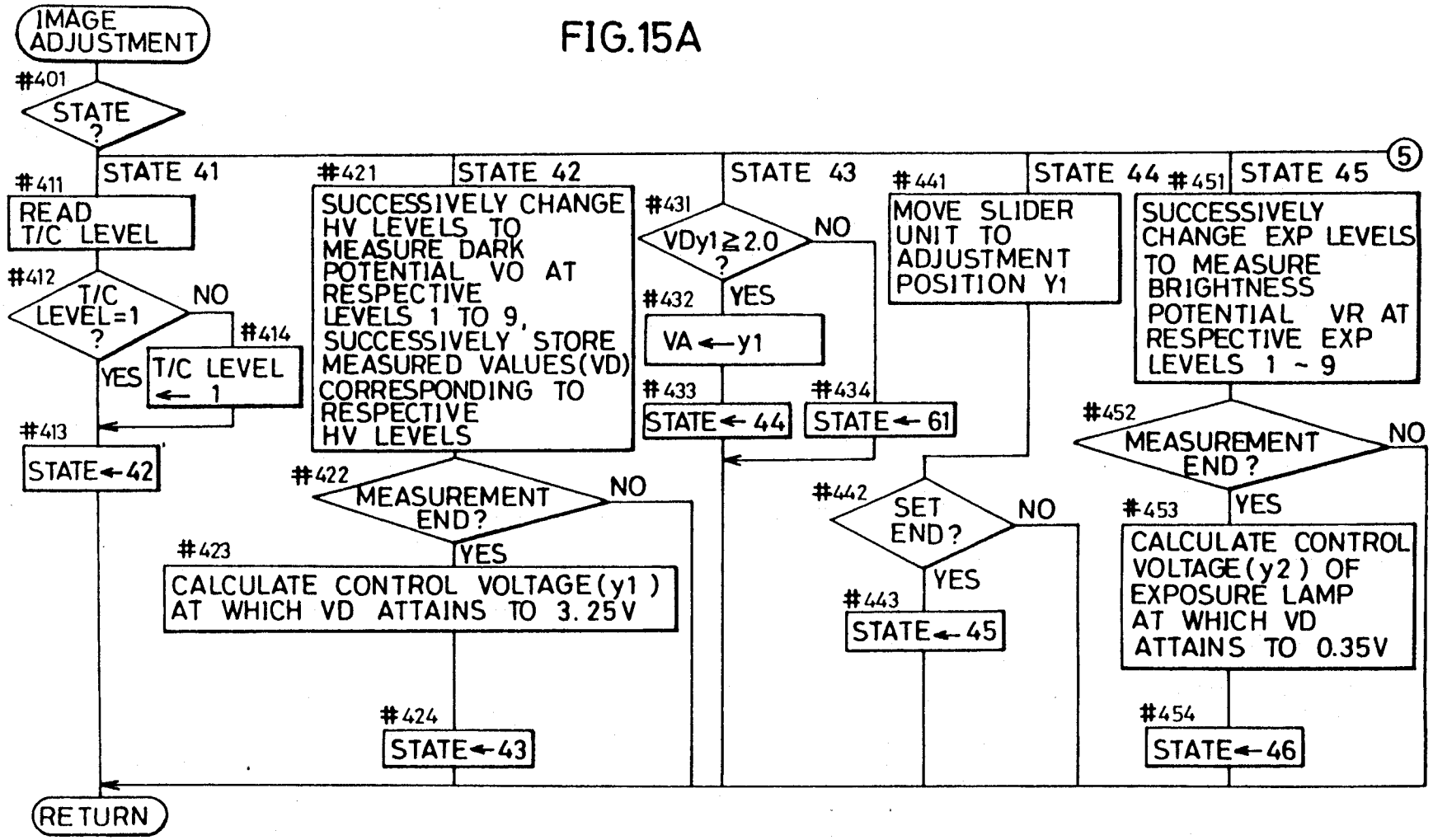
FIGS. 15A to 15E are flow charts showing image adjusting process in accordance with another embodiment of the present invention.
Figure 15B:
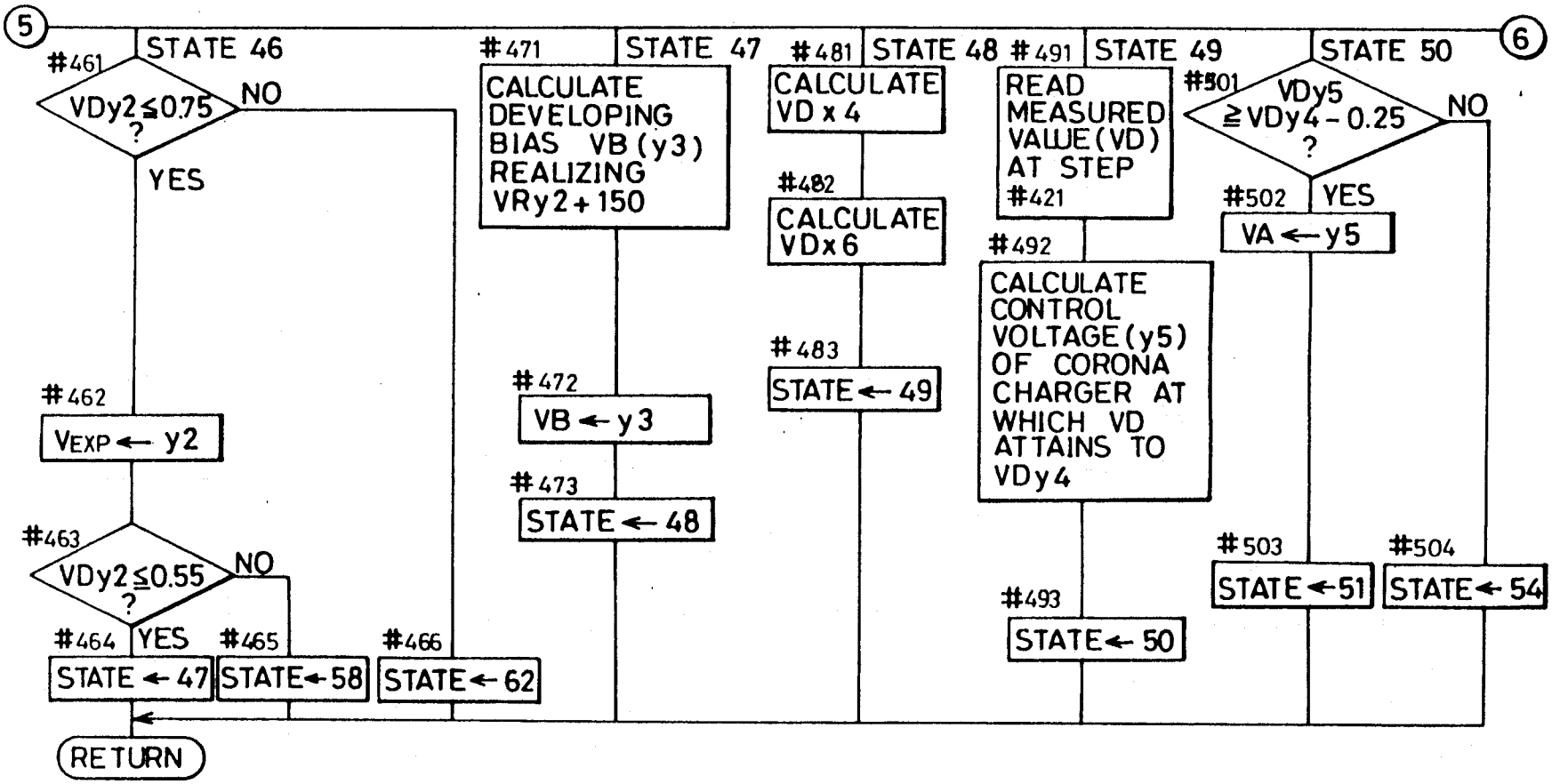
Figure 15C:
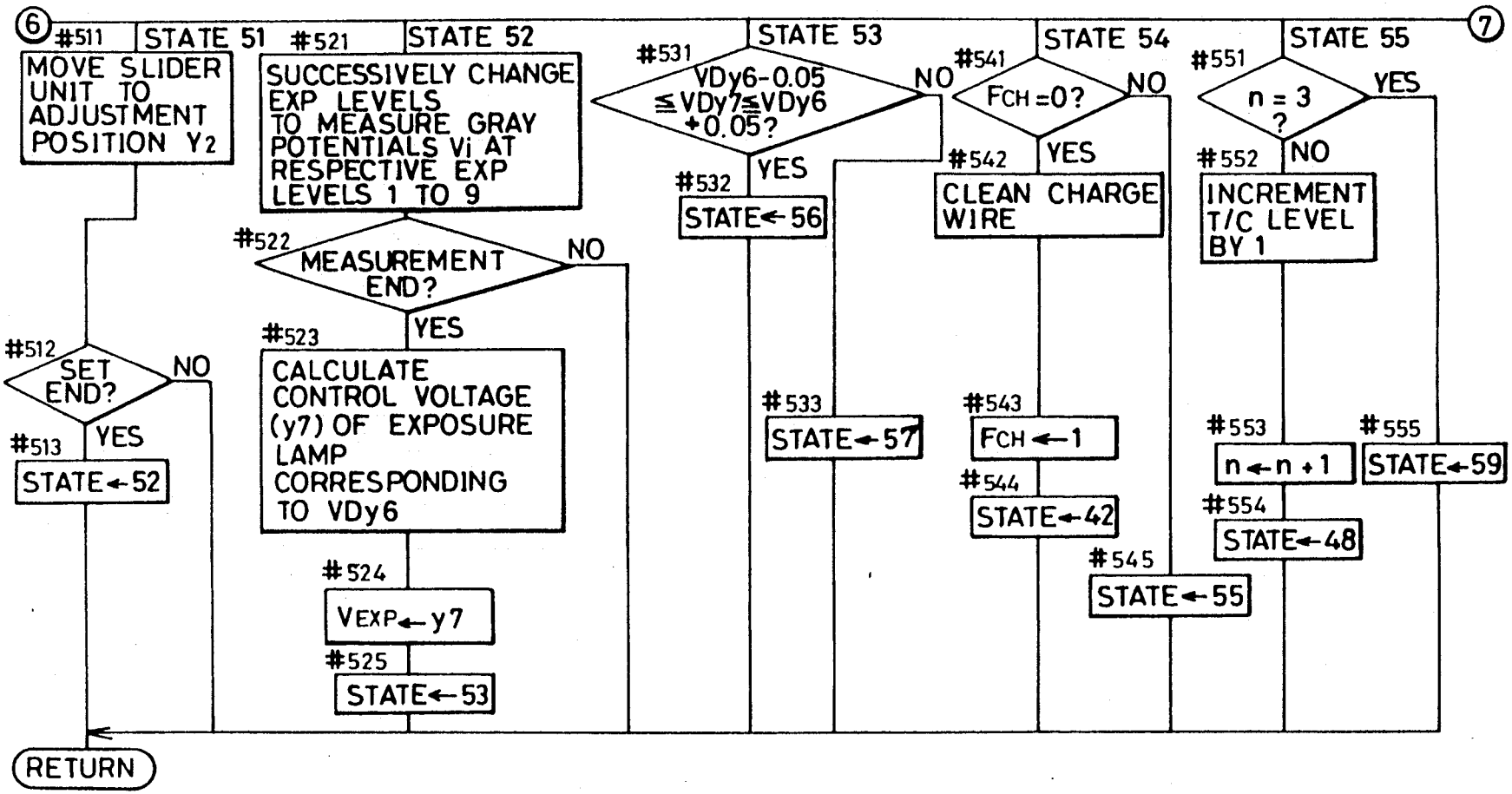
Figures 15D, 15E:
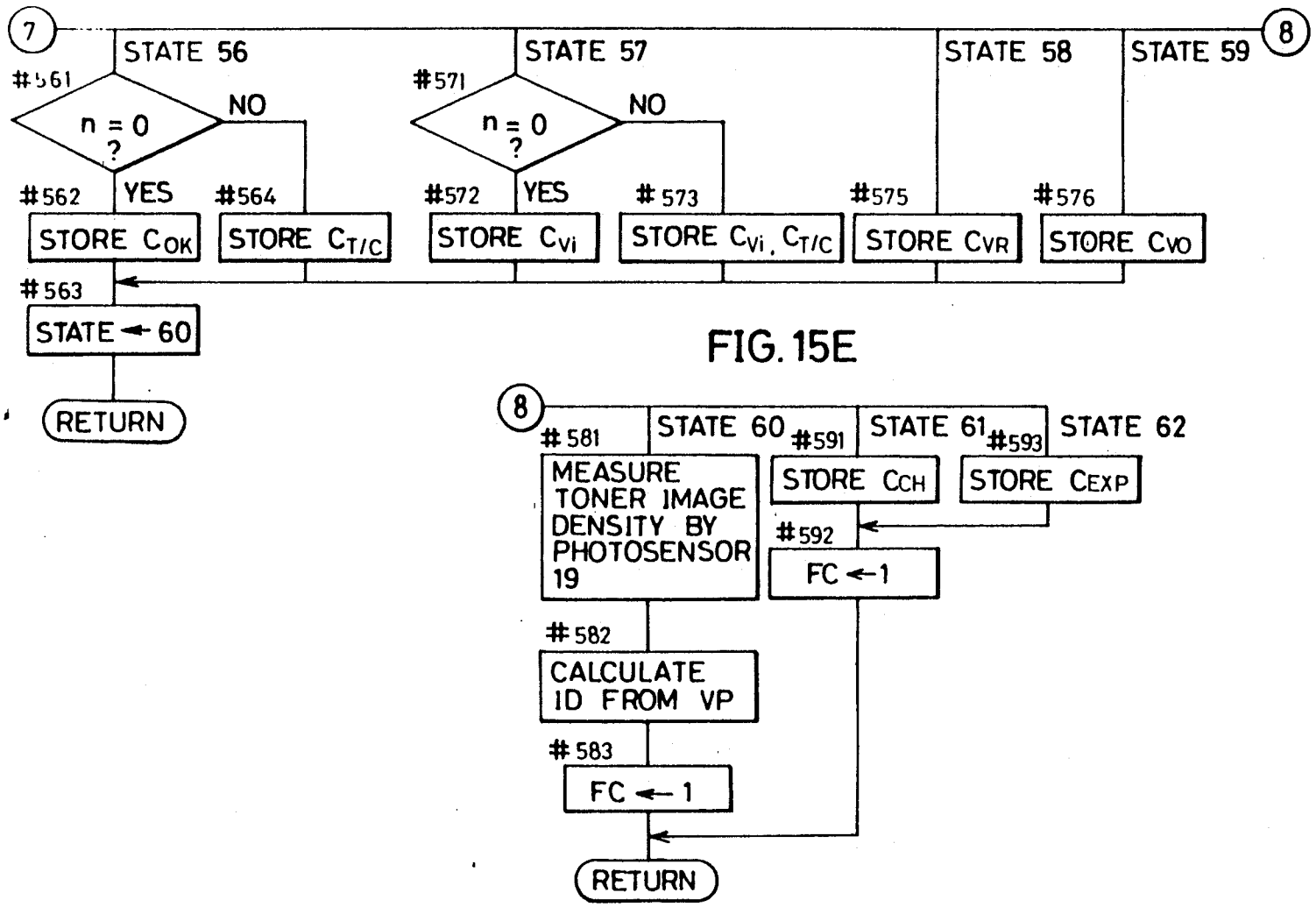

FIG. 14 is a flow chart showing the alarm display·copy inhibiting process of step #6 of FIG. 12.

In this routine also, the state is checked in step #301 at first, and the following processes are executed corresponding to the state.

In state 31, whether or not a signal S1 has been input is checked in step #311. The signal S1 is input through the interface 216 to the first CPU 201, when an up key 114 or a down key 115 on the operation panel 100 is pressed. If it is NO in step #311, the state is set to "32" in step #315.

If it is YES in step #311, it means that the operator has set density, which is one of the factors defining the image quality. In this case, it can be assumed that the operator is especially paying attention to the image quality. Therefore, if the state of operation of the copying machine A is improper, it is necessary to inform the operator that it is difficult to provide copy image of a desired quality, before starting the copying operation.

Therefore, in steps #312 to #314, whether or not the state data $C_{Vi}$, $C_{VR}$ and $C_{VO}$ are stored or not, that is, whether or not the data are in the RAM 209 is checked, respectively. If it is YES in any of the steps #312 to 314, it means that the operation state of the copying machine A is improper. In that case, the flow proceeds to step #316.

In step #316, an alarm display indicating that the operation state of the copying machine A is improper is given at a message display portion on the operation panel 100.

In state "32", whether or not the state data $C_{CH}$ has been stored is checked in step #321. If it is, an alarm display of an abnormal state is given in step #322.

Then, in step #323, a copy inhibiting process inhibiting the start of the copying operation is done. More specifically, inputs through various keys on the operation panel 100 are inhibited, and power supplies for various portions except devices related to data processing are controlled to be turned off.

Then the state is up-dated to "33" in step #324.

In state "33", whether or not the state data $C_{EXP}$ has been stored is checked in step #331. If it is YES, an alarm display of an abnormal state related to the exposure lamp 21 is given in step #332.

In step #333, the copy inhibiting process similar to that of step #323 is executed, and the state is reset to "31" in step #334.

Figure 16:
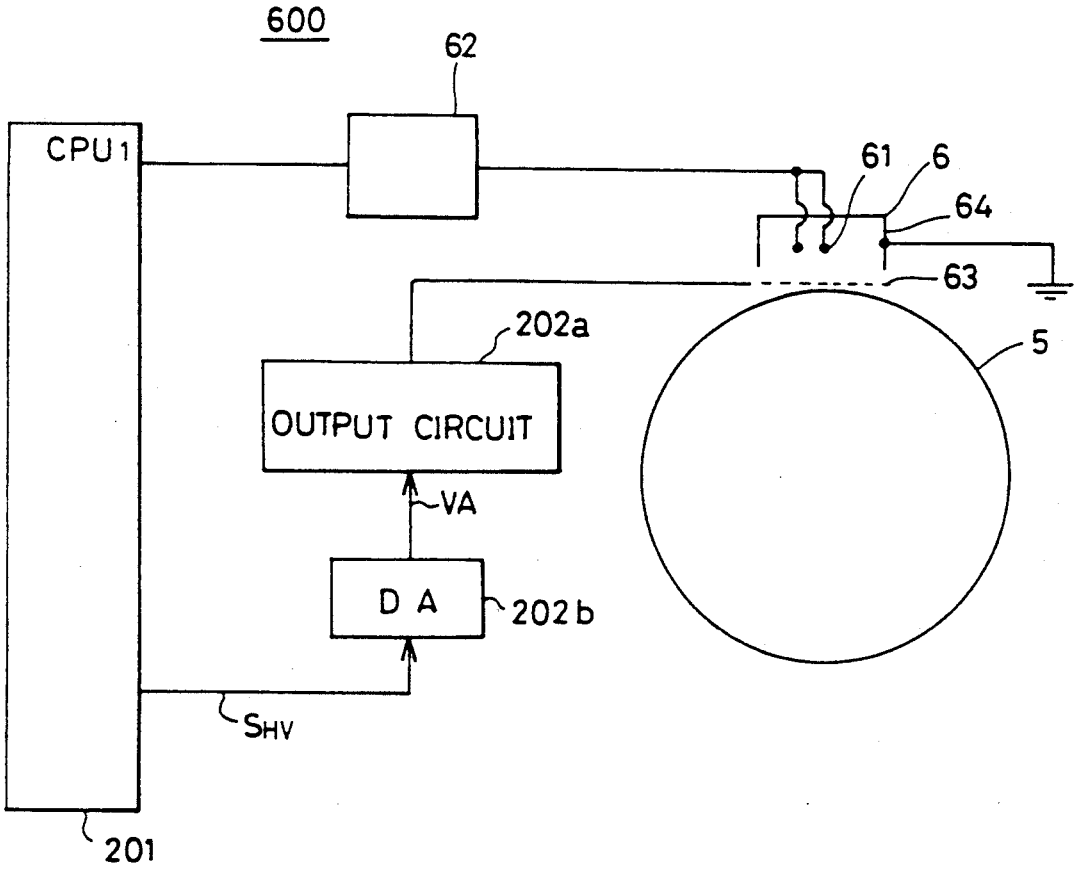
FIG. 16 shows a structure of a corona charger controlling portion in accordance with another embodiment of the present invention.

Another embodiment of the present invention will be described with reference to FIGS. 15A to 17. In FIG. 16, the same structural elements as FIG. 3 are denoted by the same reference characters.

Referring to FIG. 16, a digital control signal $S_{HV}$ from the first CPU 201 is converted to an analogue control voltage VA the value of which is variable in the range of 1 to 5 V, by an D/A converter 202*b* to be input to an output circuit 202*a*. The output circuit 202*a* can change linearly the potential of the grid 63 corresponding to the control voltage VA.

Figure 17:
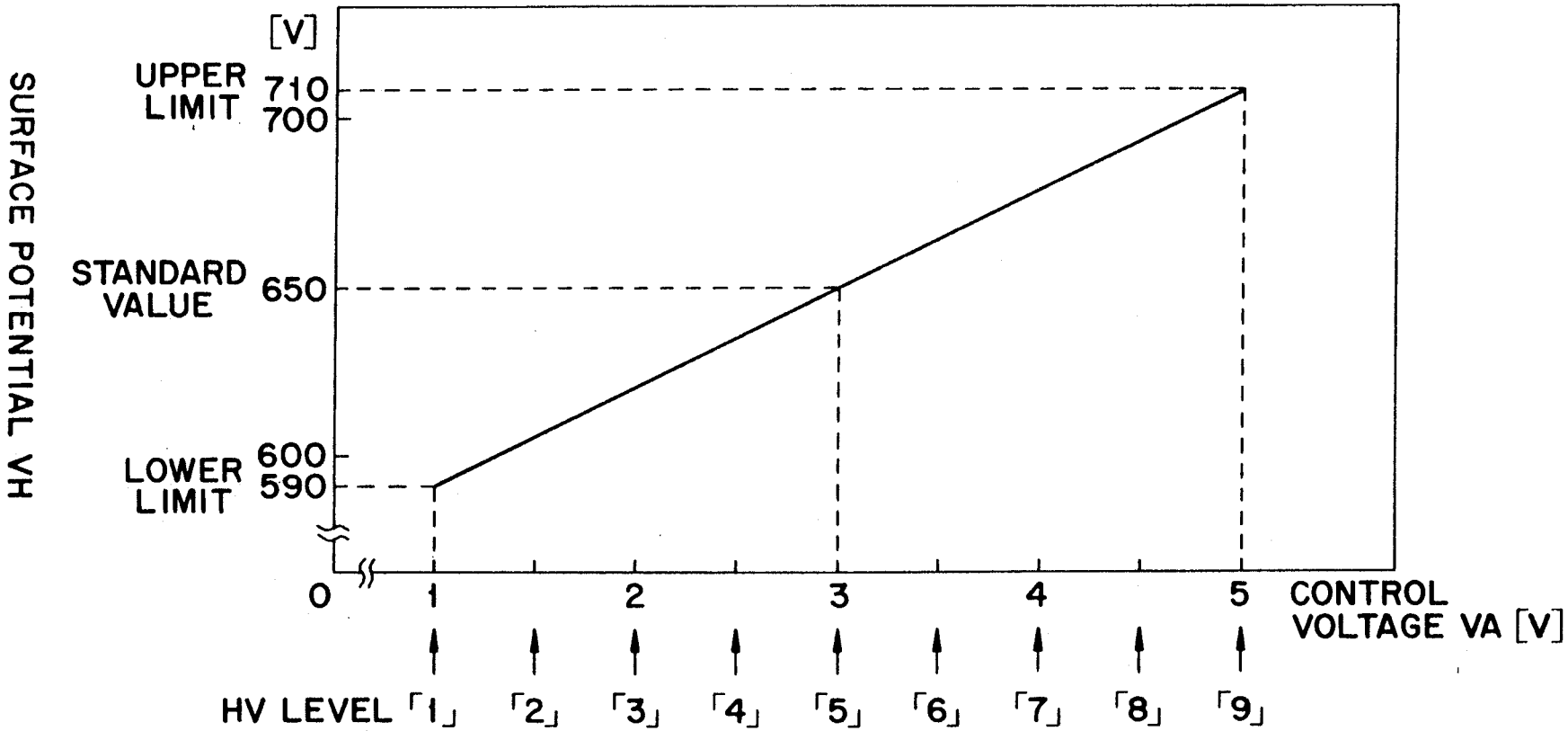
FIG. 17 shows relation between surface potential and control voltage of the corona charger.

FIG. 17 shows the relation between the control voltage VA and the surface potential VH on the photoreceptor 5, when the states of the photoreceptor 5 and the corona charger 6 are satisfactory. For example, when the control voltage VA is 3 V, the surface potential VH is 650 V, which is the standard value. However, the relation between the control voltage VA and the surface potential VH changes dependent on the environmental condition and on time change of the photoreceptor 5 and the corona charger 6.

As shown in the figure, 9 points are provided by the pitch of 0.5 V in the variable range of the control voltage VA, with the respective points denoted as HV level "1" to "9". For example, the HV level "4" is a point where the control voltage VA is 2.5 V.

Referring to FIGS. 15A to 15E, in this routine also, the state is checked at first in step #401 as in the image processing shown in FIGS. 13A to 13E, and various processes are carried out corresponding to the state. The states "41" to "62" correspond to the states "1" to "22" of FIG. 13, respectively. Therefore, in the following, only the processes different from those in FIG. 13 will be described.

In state "42", the corona charger 6 is turned on with the exposure lamp 21 being off in step #421, and the HV level is successively changed to measure the dark potential VO at respective HV levels "1" to "9". Then the measured values (output voltages VD from the surface electrometer 90) at the respective HV levels are successively stored in the RAM 209.

When measurement for all the HV levels "1" to "9" is confirmed in step #422, a voltage Y1 of the control voltage VA at which the value of the voltage VD becomes 3.25 V corresponding to the standard value (650 V) of the dark potential VO is calculated based on the measured data provided in step #421 in accordance with the method of calculation as described later, in step #423. In this process, however, if the result of the calculation is out of the variable range of the control voltage VA, the lower limit or the upper limit (1 V or 5 V) of the control voltage VA is set as the value Y1.

The value Y1 can be calculated in accordance with the following regression equation (4).

$$VD = a + b \cdot VA \tag{4}$$

$$a = \overline{VD} - b\overline{VA}$$

$$b = \frac{\Sigma (VA - \overline{VA}) \cdot (VD - \overline{VD})}{\Sigma (VA - VA)^2}$$

The reference characters $\overline{VA}$ and $\overline{VD}$ denote mean values of VA and VD at the above mentioned 9 points.

The equation (4) shows relation between the surface potential of the photoreceptor 5 represented as the voltage VD and the control voltage at present. The value Y1 is provided by the following equation (5) which is provided by transforming the equation (4).

$$VA = (VD - a)/b \tag{5}$$

The calculated coefficients (a, b) for the equation (4) are stored in the RAM 209 to be used in the succeeding process employing the equation (4).

In state "43", whether or not the value "VDyl" of the voltage VD when the control voltage VA is Y1≧2.0 V is checked, based on the equation (4) Namely, whether or not the dark potential VO≧ the lower limit value (400 V) enabling the copying operation is checked.

If it is YES in step #431, the value yl is set as the temporary control voltage VA in step #432.

In state "45", the EXP level is successively changed to irradiate the adjustment seal 25*a* with the exposure lamp 21 being on in step #451, so as to measure the bright potential VR at respective EXP levels "1" to "9".

In step #452, completion of measurement for respective EXP levels is confirmed, and in step #453 coefficients of the regression equation with respect to the output voltage VD of the surface electrometer 90 and the control voltage $V_{EXP}$ of the exposure lamp 21 are calculated based on the result of the measurements at 9 points, and a value y2 of the control voltage $V_{EXP}$ at which the value of the output voltage VD becomes 0.35 V corresponding to the standard value (70 V) of the bright potential VR is calculated. In this case also, if the calculated value is out of the variable range of the control voltage $V_{EXD}$, the limit value of change of the control voltage $V_{EXP}$ is set as the value y2.

In state "46" whether or not the value "VDy2" of the output voltage VD when the value of the control voltage $V_{EXP}$ is y2≦0.75 V is checked. Namely, whether or not the bright potential VO≦ the upper limit (150 V) enabling the copying operation is checked.

If it is YES in step #461, the value y2 is set as the temporary control voltage $V_{EXP}$ in step #462.

In state "47", a target value y3 (VRy2+150 V) of the developing bias VB is calculated from the value "VRy2" of the bright potential VR corresponding to the calculated value "VDy2" (step #471), and the value y3 is set as the developing bias VB (step #472).

In state "48", the value y3 is substituted for VB of the equation shown in FIG. 7 to calculate the target value "VOy4" of the dark potential VO in step #481, and a value "VDy4" of the output voltage VD corresponding thereto is calculated.

Then in step #482, the value "VDy6" of the output voltage VD corresponding to the target value "Viy6" of the gray potential Vi is calculated based on the equation of the gray potential Vi shown in FIG. 7.

In state "49", measurements of the surface potential corresponding to the respective HV level are not newly carried out, but the measured values VD stored in the step #421 of the state "42" are read (step #491), and a value y5 of the control voltage VA at which the measured valued VD becomes equal to the calculated value "VDy4" is calculated (step #492).

The value y5 of the control voltage may be calculated not by reading the measured values VD stored in the step #421 but by reading the coefficients (a, b) which were stored when the value yl of the control voltage was calculated in step #423.

In state "52", the gray potentials Vi at respective EXP levels "1" t "9" are measured in step #521.

In step #523, the value y7 of the control voltage $V_{EXP}$ of the exposure lamp 21 corresponding to the aforementioned value "VDy6" is calculated based on the result of measurement in step #521, and in step #524, the value y7 is set as the control voltage $V_{EXP}$.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:
a photoreceptor;
charging means for charging said photoreceptor;
exposing means for exposing said photoreceptor;
developing means for applying toner on a surface of said photoreceptor;
measuring means for measuring surface potential of said photoreceptor;
storing means for storing measured data from said measuring means;
first controlling means for controlling said charging means, measuring means and storing means such that an operation level of said charging means is changed stepwise when the operation level of said charging means is set for a first time while said measuring means measures the surface potential of said photoreceptor at respective steps of the operation level, and that said measured surface potential levels corresponding to said respective steps of the operation level are stored by said storing means; and
second controlling means for controlling said charging means such that when the operation level of said charging means is set for a second and subsequent times, the operation level of said charging means is set based on said measured surface potential levels read from said storing means.

2. An apparatus according to claim 1, wherein
said storing means stores measured surface potential levels when the surface potential of said photoreceptor not exposed by said exposing means is measured.

3. An image forming apparatus, comprising:
image forming means for forming an image on a sheet of recording paper;
measuring means for measuring property values incidental to an image forming process by said image forming means;
setting means for setting an operation level of said image forming means, based on measured data from said measuring means;
storing means for storing said measured property values of said measuring means; and
controlling means for controlling said image forming means such that the property values measured when the operation level of said image forming means is set for the first time is stored in said storing means and that the operation level of said image forming means is set at a second and subsequent times based on the measured property values read from said storing means.

4. An apparatus according to claim 3, wherein
said image forming means includes:
a photoreceptor;
charging means for charging said photoreceptor;
exposing means for exposing said photoreceptor; and
developing means for applying toner to said photoreceptor.

5. An apparatus according to claim 4, wherein
said setting means sets a level of charging said photoreceptor by said charging means.

6. An apparatus according to claim 4, wherein
said measuring means measures surface potential of said photoreceptor charged by said charging means.

7. In an image forming apparatus comprising image forming means for forming an image on a sheet of recording paper, and measuring means for measuring property values incidental to an image forming process, a method of adjusting image quality by adjusting an operation level of said image forming means, comprising the steps of:
changing stepwise the operation level of said image forming means and measuring the property values corresponding to respective steps of the operation level by said measuring means;
storing data measured by said measuring means by storing means;
setting the operation level of said image forming means a first time based on said measured property values;
reading said measured data from said storing means; and
setting the operation level of said image forming means a second and subsequent times based on said read measured data.

8. An image forming apparatus, comprising:
a photoreceptor,
charging means for charging said photoreceptor;
exposing means for exposing said photoreceptor;
developing means for applying toner to a surface of said photoreceptor;

measuring means for measuring a surface potential of said photoreceptor;

setting means for setting a level of charging by said charging means in accordance with a prescribed calculation using measured data provided by said measuring means;

storing means for storing said measured data;

first controlling means for controlling said storing means such that an operation level of said charging means is changed stepwise when the operation level of said charging means is set for a first time, and that measured data corresponding to respective steps are stored; and second controlling means for setting said charge level in accordance with said prescribed calculation, by using the measured data read from said storing means when the operation level of said charging means is set for a second and subsequent times.

9. An apparatus according to claim 8, wherein said setting means sets said charge level by calculating voltage of said charging means in accordance with said prescribed calculation using said measured data.

10. An apparatus according to claim 8, wherein said storing means stores measured data when the surface potential of said photoreceptor which is not exposed is measured.

11. An image forming apparatus, comprising:

image forming means for forming an image on a sheet of recording paper;

measuring means for measuring property values incidental to an image forming process by said image forming means;

storing means for storing property values measured by said measuring means;

setting means for setting an operation level of said image forming means in accordance with a prescribed calculation using said measured property values; and controlling means for controlling said setting means such that property values measured when the operation level of said image forming means is set for the first time is stored in said storing means and that said operation level is set in accordance with said prescribed calculation by using said measured data read from said storing means, when the operation level is set for the second and subsequent times.

12. An apparatus according to claim 11, wherein said image forming means includes:

a photoreceptor;

charging means for charging said photoreceptor;

exposing means for exposing said photoreceptor; and developing means for applying toner to a surface of said photoreceptor.

13. An apparatus according to claim 12, wherein said setting means sets a level of charging said photoreceptor by said charging means.

14. An apparatus according to claim 12, wherein said measuring means measures surface potential of said photoreceptor charged by said charging means.

15. In an image forming apparatus comprising image forming means for forming an image on a sheet of recording paper, and measuring means for measuring property values related to an image forming process by said image forming means, wherein image quality of said image is adjusted by adjusting an operation level of said image forming means, a method of forming an image, comprising the steps of:

changing stepwise the operation level of said image forming means, measuring the property values corresponding to respective steps of the operation level by said measuring means;

storing the property values measured by said measuring means;

setting the operation level of said image forming means in accordance with a prescribed calculation using said measured property values;

reading said stored measured data; and setting the operation level of said image forming means in accordance with said prescribed calculation, using said read measured property values.

* * * * *